US008128758B2

(12) United States Patent
Nozawa et al.

(10) Patent No.: US 8,128,758 B2
(45) **Date of Patent: *Mar. 6, 2012**

(54) R-FE-B MICROCRYSTALLINE HIGH-DENSITY MAGNET AND PROCESS FOR PRODUCTION THEREOF

(75) Inventors: Noriyuki Nozawa, Osaka (JP); Takeshi Nishiuchi, Osaka (JP); Satoshi Hirosawa, Osaka (JP); Tomohito Maki, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 485 days.

This patent is subject to a terminal disclaimer.

(21) Appl. No.: 12/254,967

(22) Filed: Oct. 21, 2008

(65) Prior Publication Data

US 2009/0032147 A1 Feb. 5, 2009

Related U.S. Application Data

(63) Continuation of application No. PCT/JP2007/072213, filed on Nov. 15, 2007.

(30) Foreign Application Priority Data

Nov. 30, 2006 (JP) ..... 2006-324298
Apr. 26, 2007 (JP) ..... 2007-116661

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS 4,981,532 A 1/1991 Takeshita et al.
5,110,374 A 5/1992 Takeshita et al.
(Continued)

FOREIGN PATENT DOCUMENTS

EP 0 411 571 A2 2/1991
(Continued)

OTHER PUBLICATIONS

English translation of the official communication issued in International Application No. PCT/JP2007/072213, mailed on Jun. 11, 2009.

(Continued)

*Primary Examiner* — John Sheehan
(74) *Attorney, Agent, or Firm* — Keating & Bennett, LLP

(57) ABSTRACT

An R—Fe—B based rare-earth alloy powder with a mean particle size of less than about 20 μm is provided and compacted to make a powder compact. Next, the powder compact is subjected to a heat treatment at a temperature of about 550° C. to less than about 1,000° C. within hydrogen gas, thereby producing hydrogenation and disproportionation reactions (HD processes). Then, the powder compact is subjected to another heat treatment at a temperature of about 550° C. to less than about 1,000° C. within either a vacuum or an inert atmosphere, thereby producing desorption and recombination reactions and obtaining a porous material including fine crystal grains, of which the density is about 60% to about 90% of their true density and which have an average crystal grain size of about 0.01 μm to about 2 μm (DR processes). Thereafter, the porous material is subjected to yet another heat treatment at a temperature of about 750° C. to less than about 1,000° C. within either the vacuum or the inert atmosphere, thereby further increasing its density to about 93% or more of their true density and making an R—Fe—B based microcrystalline high-density magnet.

14 Claims, 11 Drawing Sheets

U.S. PATENT DOCUMENTS

| | | | | |
|---|---|---|---|---|
| 5,250,206 | A | 10/1993 | Nakayama et al. | |
| 5,395,462 | A | 3/1995 | Takeshita et al. | |
| 2004/0241034 | A1* | 12/2004 | Mino et al. | 419/66 |
| 2005/0067052 | A1* | 3/2005 | Honkura et al. | 148/105 |

FOREIGN PATENT DOCUMENTS

| | | | |
|---|---|---|---|
| EP | 1 830 371 | A1 | 9/2007 |
| JP | 02-004901 | A | 1/1990 |
| JP | 02-039503 | A | 2/1990 |
| JP | 03-080508 | A | 4/1991 |
| JP | 3-129702 | A | 6/1991 |
| JP | 04-165012 | A | 6/1992 |
| JP | 05-047528 | A | 2/1993 |
| JP | 06-112027 | A | 4/1994 |
| JP | 08-107007 | A | 4/1996 |
| JP | 09-148163 | A | 6/1997 |
| JP | 9-162054 | A | 6/1997 |
| JP | 11-195548 | A | 7/1999 |
| JP | 2000-173810 | A | 6/2000 |
| JP | 2001-085256 | A | 3/2001 |
| JP | 2002-75715 | A | 3/2002 |
| JP | 2003-264115 | A | 9/2003 |
| JP | 2004-303909 | A | 10/2004 |
| WO | 2007102391 | A1 | 9/2007 |
| WO | 2007/135981 AI | | 11/2007 |

OTHER PUBLICATIONS

Official Communication issued in corresponding European Patent Application No. 07831943.1, mailed on Oct. 7, 2011.

Official Communication issued in corresponding Japanese Patent Application No. 2008-546943, mailed on Oct. 25, 2011.

Official Communication issued in International Patent Application No. PCT/JP2007/072213, mailed on Feb. 19, 2008.

Yoshimura et al.: "R-Fe-B Rare Earth Sintered Magnet and Method for Producing Same," U.S. Appl. No. 12/092,286, filed May 1, 2008.

Nishiuchi et al.: "R-Fe-B Porous Magnet and Method for Producing the Same," U.S. Appl. No. 12/092,300, filed May 1, 2008.

* cited by examiner

AFTER HDDR PROCESSES

BEFORE HDDR PROCESSES

R-FE-B MICROCRYSTALLINE HIGH-DENSITY MAGNET AND PROCESS FOR PRODUCTION THEREOF

BACKGROUND OF THE INVENTION

1. Field of the Invention

The present invention relates to an R—Fe—B based microcrystalline high-density magnet produced by an HDDR process and a method for producing such a magnet.

2. Description of the Related Art

An R—Fe—B based rare-earth magnet (where R is a rare-earth element, Fe is iron, and B is boron) is a typical high-performance permanent magnet, has a structure including, as a main phase, an $R_2Fe_{14}B$ phase, which is a ternary tetragonal compound, and exhibits excellent magnet performance. Such R—Fe—B based rare-earth magnets are roughly classifiable into sintered magnets and bonded magnets. A sintered magnet is produced by compacting a fine powder of an R—Fe—B based magnet alloy (with a mean particle size of several μm) with a press machine and then sintering the resultant compact. On the other hand, a bonded magnet is produced by compression-molding or injection-molding a mixture (i.e., a compound) of a powder of an R—Fe—B based magnet alloy (with particle sizes of about 100 μm) and a binder resin.

The sintered magnet is made of a powder with relatively small particle sizes, and therefore, the respective powder particles thereof exhibit magnetic anisotropy. For that reason, an aligning magnetic field is applied to the powder being compacted by the press machine, thereby making a powder compact in which the powder particles are aligned with the direction of the magnetic field.

The powder compact obtained in this manner is then sintered normally at a temperature of 1,000° C. to 1,200° C. and then heat-treated if necessary to be a permanent magnet. In the sintering process, the atmosphere is often a vacuum atmosphere or an inert atmosphere to reduce the oxidation of the rare-earth element.

To make the bonded magnet exhibit magnetic anisotropy on the other hand, the hard magnetic phases in the powder particles used should have their easy magnetization axes aligned in one direction. Also, to achieve coercivity to a practically required level, the crystal grain size of the hard magnetic phases that form the powder particles should be reduced to around the single domain critical size. For these reasons, to produce a good anisotropic bonded magnet, a rare-earth alloy powder that satisfies all of these conditions needs to be obtained.

To make a rare-earth alloy powder for an anisotropic bonded magnet, an HDDR (hydrogenation-disproportionation-desorption-recombination) process is generally adopted. The "HDDR" means a process in which hydrogenation, disproportionation, desorption and recombination are carried out in this order. In the known HDDR process, an ingot or powder of an R—Fe—B based alloy is maintained at a temperature of 500° C. to 1,000° C. within an $H_2$ gas atmosphere or a mixture of an $H_2$ gas and an inert gas so as to occlude hydrogen into the ingot or the powder. After that, the desorption process is carried out at the temperature of 500° C. to 1,000° C. until either a vacuum atmosphere with an $H_2$ pressure of 13 Pa or less or an inert atmosphere with an $H_2$ partial pressure of 13 Pa is created and then a cooling process is carried out.

In this process, the reactions typically advance in the following manner. Specifically, as a result of a heat treatment process for producing the hydrogen occlusion, the hydrogenation and disproportionation reactions (which are collectively referred to as "HD reactions" that may be represented by the chemical reaction formula: $Nd_2Fe_{14}B+2H_2 \rightarrow 2NdH_2+12Fe+Fe_2B$) advance to form a fine structure. Thereafter, by carrying out another heat treatment process to produce the desorption, the desorption and disproportionation reactions (which are collectively referred to as "DR reactions" that may be represented by the chemical reaction formula: $2NdH_2+12Fe+Fe_2B \rightarrow Nd_2Fe_{14}B+2H_2$) are produced to make an alloy with very fine $R_2Fe_{14}B$ crystalline phases.

An R—Fe—B based alloy powder, produced by such an HDDR process, exhibits high coercivity and has magnetic anisotropy. The alloy powder has such properties because the metallurgical structure thereof substantially becomes an aggregate structure of crystals with very small sizes of 0.1 μm to 1 μm. Also, if the reaction conditions and composition are selected appropriately, the easy magnetization axes of the crystals will be aligned in one direction, too. More specifically, the high coercivity is achieved because the sizes of the fine crystal grains, obtained by the HDDR process, are close to the single domain critical size of a tetragonal $R_2Fe_{14}B$ based compound. The aggregate structure of those fine crystals of the tetragonal $R_2Fe_{14}B$ based compound will be referred to herein as a "recrystallization texture". Methods of making an R—Fe—B based alloy powder having the recrystallization texture by the HDDR process are disclosed in Patent Documents Nos. 1 and 2, for example.

A magnetic powder made by the HDDR process (which will be referred to herein as an "HDDR powder") is normally mixed with a binder resin (which is also simply referred to as a "binder") to make a compound, which is then either compression-molded or injection-molded under a magnetic field, thereby producing an anisotropic bonded magnet. The HDDR powder will usually aggregate after the HDDR process. Thus, to use the powder to make an anisotropic bonded magnet, the aggregate structure is broken down into the powder again. For example, according to Patent Document No. 1, the magnet powder obtained preferably has a particle size of 2 μm to 500 μm. In Example 1 of that document, an aggregate structure obtained by subjecting a powder with a mean particle size of 3.7 μm to the HDDR process is crushed in a mortar to obtain a powder with a mean particle size of 5.8 μm. Thereafter, the powder is mixed with a bismaleimide triazine resin and then the compound is compression-molded to make a bonded magnet.

On the other hand, various techniques for making a microcrystalline high-density magnet by taking advantage of the HDDR process have also been proposed. According to one of those techniques, an HDDR magnetic powder is aligned and then turned into a bulk material by a hot compaction process such as a hot pressing process or a hot isostatic pressing (HIP) process. Such a technique is disclosed in Patent Documents Nos. 3 to 8, for example. By adopting a hot compaction process, the density of the powder can be increased at temperatures of 600° C. to 900° C., which are lower than the sintering temperature. As a result, a bulk magnet can be produced with the recrystallization texture of the HDDR powder maintained.

Meanwhile, according to Patent Document No. 9, an alloy that has been subjected to HD reactions and a desorption reaction to such a degree as to produce no coercivity yet is compacted under a magnetic field, and the resultant powder compact is subjected to DR reactions and then hot pressing. In this manner, the demagnetization process can be omitted when the powder needs to be compacted under a magnetic field and yet the anisotropy can be increased, according to Patent Document No. 9.

Also, according to the method disclosed in Patent Document No. 10, an R—Fe—B based alloy that has been prepared by melting materials in an induction melting furnace is subjected to a solution treatment, if necessary, cooled, and then pulverized into a coarse powder. The powder is further pulverized finely to a size of 1 μm to 10 μm using a jet mill, for example, and then compacted under a magnetic field. Thereafter, the green compact is sintered at a temperature of 1,000° C. to 1,140° C. within either a high vacuum or an inert atmosphere. Then, the sintered compact is heated to a temperature of 600° C. to 1,100° C. within a hydrogen atmosphere and then thermally treated within a high vacuum, thereby reducing the size of the main phase to 0.01 μm to 1 μm.

Furthermore, according to the method disclosed in Patent Document No. 11, first, an alloy that has been subjected to a solution treatment process is pulverized to a particle size of less than 10 μm with a pulverizer such as a jet mill, and then the powder is compacted under a magnetic field to obtain a powder compact. Then, the powder compact is treated at a temperature of 600° C. to 1,000° C. within hydrogen and then at a temperature of 1,000° C. to 1,150° C. This series of processes carried out on the powder compact corresponds to the HDDR process. In this case, however, the temperature of the DR process is higher than the rest of the process. According to the method disclosed in Patent Document No. 11, the sintering process is advanced by the DR process at the higher temperature, and therefore, the powder compact can be sintered as densely as it has been. Patent Document No. 11 says that the sintering process should be carried out at a temperature of at least 1,000° C. to make a sintered body with high density.

Patent Document No. 1: Japanese Patent Application Laid-Open Publication No. 1-132106

Patent Document No. 2: Japanese Patent Application Laid-Open Publication No. 2-4901

Patent Document No. 3: Japanese Patent Application Laid-Open Publication No. 2-39503

Patent Document No. 4: Japanese Patent Application Laid-Open Publication No. 4-245403

Patent Document No. 5: Japanese Patent Application Laid-Open Publication No. 4-246803

Patent Document No. 6: Japanese Patent Application Laid-Open Publication No. 4-247604

Patent Document No. 7: Japanese Patent Application Laid-Open Publication No. 4-253304

Patent Document No. 8: Japanese Patent Application Laid-Open Publication No. 11-195548

Patent Document No. 9: Japanese Patent Application Laid-Open Publication No. 2001-85256

Patent Document No. 10: Japanese Patent Application Laid-Open Publication No. 4-165012

Patent Document No. 11: Japanese Patent Application Laid-Open Publication No. 6-112027

It is well known to those skilled in the art that crystals at the uppermost surface of an $Nd_2Fe_{14}B$-type magnet have no coercivity. A sintered magnet includes a higher percentage of $Nd_2Fe_{14}B$ phase as a hard magnetic phase, and therefore achieves better magnetic properties, than a bonded magnet. However, a sintered magnet normally has a crystal grain size of approximately 3 to 10 μm. Thus, it is also known that if a sintered magnet is machined to a size of 3 mm or less, for example, the effect of that uppermost surface portion with no coercivity will manifest itself and cause significant deterioration in its properties.

Meanwhile, a microcrystalline high-density magnet, produced by an HDDR process, not only has as high a percentage of a hard magnetic phase as a sintered magnet but also has its properties deteriorated to a much lesser degree than a sintered magnet because the magnet of the former type has fine crystal grains with a size of 0.1 μm to 1 μm.

However, even such a microcrystalline high-density magnet obtained by an HDDR process would achieve poor productivity if such a magnet were produced by the manufacturing process in which the HDDR powder is aligned under a magnetic field and then turned into a bulk by a hot compaction process such as hot pressing as disclosed in Patent Documents Nos. 3 to 9. As a result, the manufacturing cost would increase and it would be difficult to mass-produce such magnets at a cost that is low enough to make general-purpose motors.

According to the manufacturing process disclosed in Patent Document No. 10, the size of the main phase is reduced by subjecting the sintered body to the HDDR process. In the HDDR process, however, the volume varies during the HD reaction or the DR reaction. For that reason, when subjected to the HDDR process, the sintered body easily cracks and cannot be produced at a high yield. Also, since a bulk body (sintered body) that has already had its density increased is subjected to the HDDR process, hydrogen, which is an essential element for the HD reaction, will have its diffusion path limited. As a result, the homogeneity of the texture would decrease in the resultant magnet or it would take a lot of time to get the process done. Consequently, the size of the magnet that can be made would be restricted.

According to Patent Document No. 11, by performing a DR process at a temperature of 1,000° C. to 1,150° C., the density of the resultant magnet can be increased without increasing the size of the fine crystal grains and better magnetic properties than a normal R—Fe—B based sintered magnet should be achieved. However, the present inventors discovered and confirmed via experiments that when a sintering process was carried out at 1,000° C. or more in the DR process, it was difficult to increase the density while keeping the crystal grains size so small but abnormal grain growth occurred noticeably. As a result, the magnetic properties eventually deteriorated more than a normal sintered magnet (see Table 2 and Comparative Example 1 to be described later).

SUMMARY OF THE INVENTION

In order to overcome the problems described above, preferred embodiments of the present invention provide a method for producing an R—Fe—B based microcrystalline high-density magnet relatively easily and cost-effectively on an industrial basis without allowing the magnet to exhibit deteriorated properties even if its size is as small as 3 mm or less, for example.

A method for producing an R—Fe—B based microcrystalline high-density magnet according to a preferred embodiment of the present invention includes the steps of: (A) providing an R—Fe—B based rare-earth alloy powder (where R is at least one element selected from the group consisting of the rare-earth elements including Y and Sc) with a mean particle size of less than about 20 μm; (B) compacting the R—Fe—B based rare-earth alloy powder to make a powder compact; (C) subjecting the powder compact to a heat treatment at a temperature of about 550° C. to less than about 1,000° C. within hydrogen gas, thereby producing hydrogenation and disproportionation reactions; (D) subjecting the powder compact to another heat treatment at a temperature of about 550° C. to less than about 1,000° C. within either a vacuum or an inert atmosphere, thereby producing desorption and recombination reactions and obtaining a porous material including fine crystal grains, of which the density is about 50% to about 90% of their true density and which have an average crystal grain size of about 0.01 μm to about 2 μm; and (E) subjecting the porous material to yet another heat treatment at a temperature of about 750° C. to less than about 1,000° C. within either the vacuum or the inert atmosphere, thereby further increasing its density to about 93% or more of their true density.

In one preferred embodiment, the step (B) includes the step of compacting the powder under a magnetic field.

In another preferred embodiment, the method includes, at the beginning of the step (C), the step of defining the composition of the rare-earth element R such that the content R' of the rare-earth element in the powder compact, which is calculated by the following Equation (1):

$$R' = (\text{atomic percentage of } R) - (\text{atomic percentage of } T) \times 1/7 - (\text{atomic percentage of } O) \times 2/3 \quad (1)$$

(where T is at least one transition metal element selected from the group consisting of Fe, Co and Ni and including about 50% or more of Fe) satisfies R'≧0 at % and controlling the content of oxygen (O) between the end of the step (A) and the start of the step (C).

In still another preferred embodiment, the R—Fe—B based rare-earth alloy powder has been obtained by pulverizing a rapidly solidified alloy.

In a specific preferred embodiment, the rapidly solidified alloy is a strip cast alloy.

In yet another preferred embodiment, the step (C) includes increasing the temperature within the inert atmosphere or the vacuum and introducing the hydrogen gas at the temperature of about 550° C. to less than about 1,000° C.

In yet another preferred embodiment, the hydrogen gas has a partial pressure of about 1 kPa to about 100 kPa in the step (C).

In yet another preferred embodiment, the R—Fe—B based rare-earth alloy powder provided in the step (A) has a mean particle size of less than about 10 μm, and in the steps (C) and (D), the heat treatments are conducted at a temperature of about 650° C. to less than about 1,000° C.

In yet another preferred embodiment, the method further includes, after the step (C) and before the step (E), the step (F) of introducing a different material from the R—Fe—B based porous material into micropores of the R—Fe—B based porous material by a wet process.

In yet another preferred embodiment, the method further includes, after the step (C) and before the step (E), the step (F') of introducing at least one of a rare-earth metal, a rare-earth alloy and a rare-earth compound onto the surface of the R—Fe—B based porous material and/or into micropores thereof.

In this particular preferred embodiment, the steps (E) and (F') are performed simultaneously.

A method of making an R—Fe—B based magnet powder according to a preferred embodiment of the present invention includes the step of pulverizing the R—Fe—B based microcrystalline high-density magnet that has been produced by the method for producing such a magnet according to a preferred embodiment of the present invention.

A method for producing a bonded magnet according to a preferred embodiment of the present invention includes the steps of: preparing an R—Fe—B based magnet powder by the method according to a preferred embodiment of the present invention described above; and mixing the R—Fe—B based magnet powder with a binder and compacting the powder and the binder together.

An R—Fe—B based microcrystalline high-density magnet according to a preferred embodiment of the present invention is produced by the magnet producing method of a preferred embodiment of the present invention described above. At least a portion of the magnet has an aggregate structure of $Nd_2Fe_{14}B$ type crystalline phases with an average crystal grain size of about 0.01 μm to about 2 μm and has a density that is about 93% or more of its true density.

In one preferred embodiment, some of crystal grains that form the aggregate structure have such a shape as to have b/a ratios that are less than two and the crystal grains with that shape account for at least about 50 vol % of all crystal grains, where a and b are respectively the smallest and largest sizes of each of the crystal grains.

In another preferred embodiment, the magnet satisfies the inequalities 10 at %≦R≦30 at % and 3 at %≦Q≦15 at %, where R is the mole fraction of a rare-earth element and Q is either the mole fraction of boron or the total mole fraction of boron and carbon if carbon has been added to the magnet.

Another R—Fe—B based microcrystalline high-density magnet according to a preferred embodiment of the present invention has a structure in which a number of powder particles, each having an aggregate structure of $Nd_2Fe_{14}B$ type crystalline phases with an average crystal grain size of about 0.01 μm to about 2 μm, have been combined together. The magnet has a density that is about 93% of its true density and includes rare-earth-rich phases in a region between the powder particles.

In one preferred embodiment, the magnet satisfies the inequalities 10 at %≦R≦30 at % and 3 at %≦Q≦15 at %, where R is the mole fraction of a rare-earth element and Q is either the mole fraction of boron or the total mole fraction of boron and carbon if carbon has been added to the magnet.

In another preferred embodiment, the powder particles have a mean particle size of less than about 20 μm.

In still another preferred embodiment, on a cross section that passes a center portion of the magnet, the rare-earth-rich phases are included at a density of at least about $1.2\times10^5$ phase blocks per square millimeter.

In a specific preferred embodiment, on the cross section that passes the center portion of the magnet, some of the rare-earth-rich phases have a cross-sectional area of about 1 $\mu m^2$ to about 10 $\mu m^2$ and are included at a density of at least about $1.6\times10^4$ phase blocks per square millimeter.

In yet another preferred embodiment, some of the $Nd_2Fe_{14}B$ type crystalline phases that form the aggregate structure have such a shape as to have b/a ratios that are less than two and the crystalline phases with that shape account for at least about 50 vol % of the entire aggregate structure, where a and b are respectively the smallest and largest sizes of each of the crystalline phases.

According to a preferred embodiment of the present invention, an R—Fe—B based rare-earth alloy powder to be subjected to an HDDR process is made so as to have a mean particle size of less than about 20 μm and then subjected to the HDDR process. Since the power has a relatively small mean particle size, the HDDR process can get done more uniformly. In addition, by heat-treating a DR powder to a heat treatment at a temperature of about 750° C. to about 1,000° C., the density of the magnet can be increased with its crystal grain size maintained. As a result, an R—Fe—B based microcrystalline high-density magnet, of which the magnetic properties will never deteriorate even when its thickness is decreased to about 3 mm or less, can be produced at a reduced cost and on an industrial basis. Besides, the microcrystalline high-density magnet according to a preferred embodiment of the present invention can maintain better loop squareness than a conventional HDDR magnetic powder, and therefore, can achieve better magnetic properties than a microcrystalline high-density magnet made of the conventional HDDR magnetic powder.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1A:
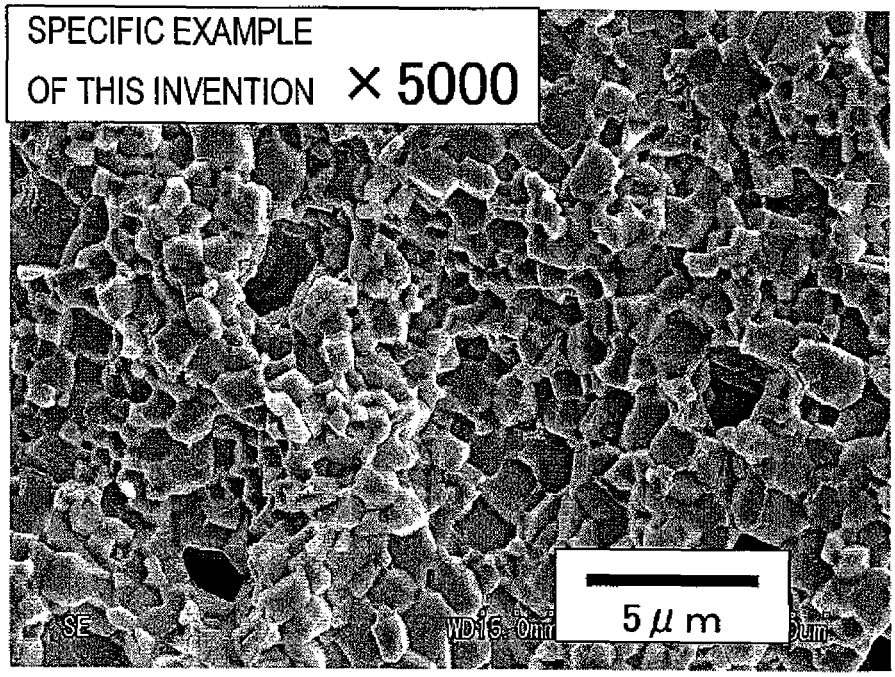
FIG. 1A is an SEM photograph showing a fractured surface of a microcrystalline high-density magnet as a specific example of a preferred embodiment of the present invention.

The conventional HDDR process is carried out to make a magnet powder to produce a bonded magnet and is performed on a powder with a relatively large mean particle size. This is because if the mean particle size were decreased, it would be difficult to break down the powder that has aggregated through the HDDR process into separate powder particles.

Meanwhile, as already described with respect to the background art, it has also been proposed that the magnetic powder be compacted by a hot process or either a sintered body or a powder compact with a size of about 10 μm or less be subjected to the HDDR process to produce a microcrystalline high-density magnet. However, considering the manufacturing cost of such a hot compaction process, cracking during the HDDR process, and deterioration in magnetic properties due to an abnormal grain growth of crystal grains, it has been impossible to produce a microcrystalline high-density magnet cost-effectively on an industrial basis.

Anisotropic high-density magnets include not only sintered magnets and bulk magnets made of an HDDR magnetic powder but also a plastic processed magnet (such as a die-upset magnet). Such a plastic process magnet is obtained by making a microcrystalline alloy ribbon and/or powder by a rapid quenching process to have an average crystal grain size of about 0.01 μm to about 0.1 μm, for example, pressing and compacting such a ribbon or powder by hot pressing, and then subjecting the resultant compact to a hot plastic process. The texture of this plastic processed magnet has had its size increased by the hot process compared to its original ribbon and/or powder and comes to have an average crystal grain size of about 0.1 μm to about 1 μm, for example, which is approximately equal to that of the microcrystalline high-density magnet according to a preferred embodiment of the present invention. However, unlike the microcrystalline high-density magnet of a preferred embodiment of the present invention, about 50 vol % or more of all crystal grains of such a magnet have a flat shape with a b/a ratio of two or more, where b and a are respectively the largest and smallest sizes of the crystal grains. Such a plastic processed magnet has a finer crystal structure compared to the crystal grain size of about 3 μm to about 10 μm of a sintered magnet. That is why even if the uppermost surface of that magnet is damaged by a machining process after that, its influence will reach a depth that is approximately equal to the crystal grain size as measured from the uppermost surface. That is to say, the properties of the magnet are not easily degraded by a machining process. However, to make the conventional plastic processed magnet, the process steps of pressing and compacting an alloy ribbon and powder by a hot process and then subjecting the powder compact to a hot plastic process must be carried out, thus requiring a much higher manufacturing cost than a normal sintered magnet. In addition, the conventional plastic processed magnet also has inconsistent properties because it is difficult to perform the plastic process uniformly and cannot be designed flexibly enough because its easy magnetization axis is defined by the direction of its plastic deformation.

The microcrystalline high-density magnet according to a preferred embodiment of the present invention has a microcrystalline structure with an average crystal grain size of about 0.01 μm to about 2 μm, typically within the range of about 0.1 μm to about 1 μm, for example, and therefore, will have its properties no more deteriorated by machining than the conventional plastic processed magnet. In addition, the magnet according to a preferred embodiment of the present invention requires no hot compaction process, and therefore, can be produced at a lower manufacturing cost, and is more suitable for mass production, than the plastic processed magnet. What is more, the magnet according to a preferred embodiment of the present invention can be designed more flexibly than the plastic processed magnet.

To increase the density of such a powder compact that has gone through the HDDR process, the present inventors dared to subject the HDDR powder to an additional heat treatment process at a temperature of about 750° C. to about 1,000° C. without taking the approach of increasing the HDDR process temperature as adopted in Patent Document No. 11. As a result, the present inventors discovered that by setting the mean particle size of the powder particles and the HDDR process temperature and process time appropriately, the density could be increased to about 93% or more of its true density while maintaining fine crystal grains with an average crystal grain size of about 0.01 μm to about 2 μm that would not cause any deterioration in magnetic properties, thus perfecting our invention.

An R—Fe—B based magnet according to a preferred embodiment of the present invention is a microcrystalline high-density magnet, at least a portion of which has an aggregate structure consisting of $Nd_2Fe_{14}B$ type crystalline phases with an average crystal grain size of about 0.01 μm to about 2 μm and of which the density is about 93% or more of its true density. This average crystal grain size of 2 μm or less is smaller than 3+μm that is the average crystal grain size of a normal R—Fe—B based sintered magnet.

FIG. 1A is an SEM photograph showing a fractured face of an R—Fe—B based microcrystalline high-density magnet representing a specific example of the present invention to be described in detail later. As can be seen from this photo, the R—Fe—B based microcrystalline high-density magnet according to a preferred embodiment of the present invention has a very fine aggregate structure with an average crystal grain size of about 2 μm or less.

Figure 2:
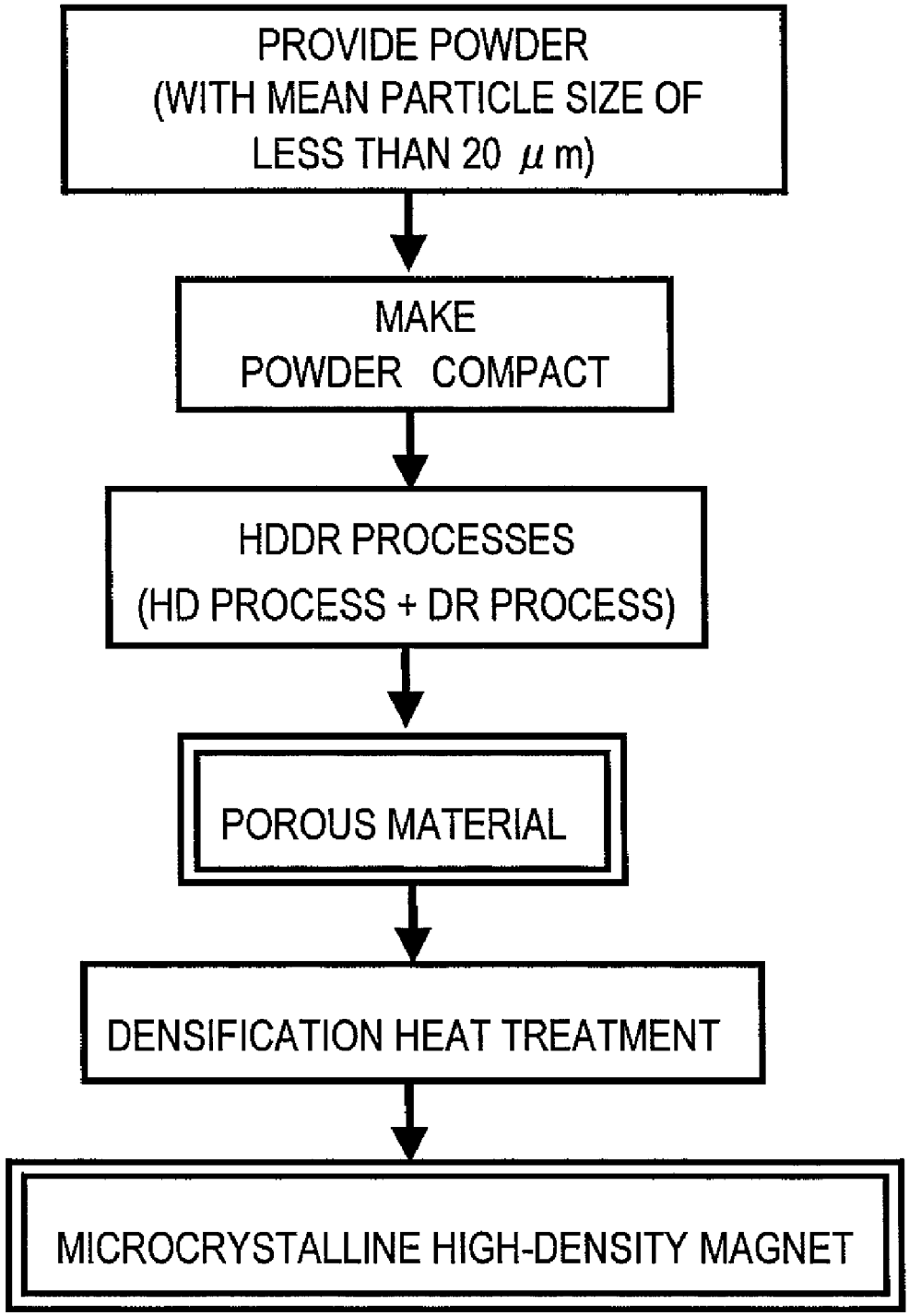
FIG. 2 is a flowchart showing how to make a microcrystalline high-density magnet according to a preferred embodiment of the present invention.

As shown in FIG. 2, the R—Fe—B based microcrystalline high-density magnet according to a preferred embodiment of the present invention is produced by performing the process steps of: preparing an R—Fe—B based rare-earth alloy powder with a mean particle size of less than about 20 μm by pulverizing a material alloy including an R—Fe—B phase; making a powder compact (i.e., a green compact) by compressing that powder; subjecting the powder compact to an HDDR process; and subjecting the resultant HDDR powder to a heat treatment process to increase its density.

By aligning the easy magnetization axis of powder particles yet to be subjected to the HDDR process in a predetermined direction, those fine $Nd_2Fe_{14}B$ type crystalline phases in the aggregate structure produced by the HDDR process can also have their easy magnetization axis aligned in the predetermined direction in the entire magnet.

After the HDDR process, the porous material has a porous structure that communicates with the air (which will be referred to herein as an "open pore structure"). Thus, by introducing a different material either into the pores or onto the surface and then subjecting the material to a densification heat treatment, a composite bulk magnet can be made easily or the performance of the magnet can be improved.

Hereinafter, a preferred embodiment of a method for producing an R—Fe—B based microcrystalline high-density magnet according to the present invention will be described in detail.

Starting Alloy

First, an R-T-Q based alloy (which will be referred to herein as a "starting alloy") including an $Nd_2Fe_{14}B$ type compound phase as a hard magnetic phase is provided. In the R-T-Q based alloy, R is a rare-earth element, which includes at least about 50 at % of Nd and/or Pr and may herein include yttrium (Y) or scandium (Sc), T is at least one transition metal element selected from the group consisting of Fe, Co and Ni and including about 50% or more of Fe, and Q is either B alone or B and C that substitutes for a portion of B.

This R-T-Q based alloy (starting alloy) includes at least about 50 vol % of $Nd_2Fe_{14}B$ type compound phase (which will be simply referred to herein as "$R_2T_{14}Q$").

Most of the rare-earth element R included in the starting alloy forms $R_2T_{14}Q$ but some of the element R forms $R_2O_3$ and other phases. The mole fraction of the rare-earth element R preferably accounts for about 10 at % to about 30 at %, and more preferably about 12 at % to about 17 at %, of the overall starting alloy. Optionally, if a portion of R is replaced with Dy and/or Tb, the coercivity can be increased.

The mole fraction of the rare-earth element R is preferably defined such that the "content of extra rare-earth element R'" (to be described later) becomes equal to or greater than 0 at %, more preferably equal to or greater than about 0.1 at %, and even more preferably equal to or greater than about 0.3 at %, when the HD process is started. In this case, the content of extra rare-earth element R' is calculated by:

$$R' = \text{"at \% of } R\text{"} - \text{"at \% of } T\text{"} \times 1/7 - \text{"at \% of } O\text{"} \times 2/3$$

The content of extra rare-earth element R' means the mole fraction of one of the rare-earth elements R that is included in the R-T-Q based alloy (starting alloy) and that does not form $R_2T_{14}B$ or $R_2O_3$ but is present as a compound other than $R_2T_{14}B$ and $R_2O_3$. Unless the mole fraction of the rare-earth elements R is defined such that the content of extra rare-earth element R' becomes equal to or greater than 0 at % of the powder compact when the HD process is started, it would be difficult to obtain fine crystals with an average crystal grain size of about 0.01 μm to about 2 μm by the method according to a preferred embodiment of the present invention. In the subsequent pulverization or compaction process, the rare-earth elements R could be oxidized by oxygen or water contained in the atmosphere. If the rare-earth elements R were oxidized, then the content of extra rare-earth element R' would decrease. For that reason, the various process steps before the HD process is started are preferably carried out in an atmosphere in which the concentration of oxygen is reduced as much as possible. However, since it is difficult to eliminate oxygen from the atmosphere completely, the mole fraction of R in the starting alloy is preferably defined with the potential decrease in R' due to oxidation in a subsequent process taken into account.

The upper limit of R' is not particularly defined but is preferably about 8 at % or less, more preferably about 5 at % or less, even more preferably about 3 at % or less, and most preferably about 2.5 at % or less, considering a potential decrease in corrosion resistance and $B_r$. R' is preferably equal to or smaller than about 8 at % and the mole fraction of the rare-earth elements R is preferably not greater than about 30 at %.

The concentration of oxygen (O) in the powder compact when the HD process is started is preferably reduced to at most about 1 mass %, more preferably about 0.6 mass % or less. The mole fraction of Q preferably accounts for about 3 at % to about 15 at %, more preferably about 5 at % to about 8 at %, and even more preferably about 5.5 at % to about 7.5 at %, of the entire alloy.

T is the balance of the alloy. To improve magnetic properties or achieve any other effect, an element such as Al, Ti, V, Cr, Ga, Nb, Mo, Ag, In, Sn, Hf, Ta, W, Cu, Si, Zr or Bi may be added appropriately. However, if the amount of such an additive were increased, the saturation magnetization, among other things, would decrease significantly. That is why the total content of these additives is preferably at most about 10 at %. Among these additives, Ti, Nb, Mo, Zr, Ta, W and Cu, in particular, can increase the degree of alignment of $R_2T_{14}Q$ after the HDDR process and can reduce the abnormal grain growth that would deteriorate the magnetic properties during the densification heat treatment process. On top of that, by adding Al or Ga, the coercivity can be increased.

According to the conventional method of making an HDDR magnet powder, the magnet powder to be subjected to the HDDR process has a mean particle size of about 30 μm or more, and typically about 50 μm or more. To make respective particles of the magnet powder exhibit good magnetic anisotropy after the HDDR process, the easy magnetization axes of the respective particles need to be aligned with one direction in the material powder. For that purpose, the starting alloy yet to be pulverized is made such that the average size of the regions in which the crystallographic orientations of the $R_2T_{14}Q$ type crystalline phases are aligned with one direction is greater than the mean particle size of the pulverized powder particles.

Consequently, according to the conventional method of making an HDDR magnet powder and the process disclosed in Patent Document No. 6, a material alloy is made by a book molding process, a centrifugal casting process or any other process and then is subjected to a heat treatment process such as a homogenizing heat treatment, thereby growing crystalline phases.

However, the present inventors discovered and confirmed via experiments that in such a material alloy in which the $R_2T_{14}Q$ type compound had been grown excessively by the book molding process or the centrifugal casting process, it was difficult to completely remove α-Fe, or initial crystals formed by casting, and α-Fe remaining in the material alloy had a harmful effect on the magnetic properties after the HDDR process.

According to the manufacturing process according to a preferred embodiment of the present invention, a powder with a mean particle size that is less than about 20 μm is preferably used, and there is no need to increase the size of a region in which the crystallographic plane orientations of $R_2T_{14}Q$ are aligned with the same direction in the material alloy unlike the conventional method of making an HDDR magnet powder. For that reason, even if an alloy obtained by rapidly cooling and solidifying a molten alloy by a strip casting process (i.e., a strip cast alloy) was used, high anisotropy could still be achieved after the HDDR process. In addition, by pulverizing such a rapidly solidified alloy into powder, the content of remaining α-Fe can be reduced compared to the material alloy (starting alloy) obtained by the conventional book molding process, for example. As a result, the deterioration in magnetic properties after the HDDR process can be minimized and good loop squareness is realized.

Material Powder

Next, a material powder is made by pulverizing the starting alloy by a known process. In this preferred embodiment, the starting alloy is coarsely pulverized by either a mechanical pulverization process using a jaw crusher, for example, or a hydrogen occlusion pulverization process to obtain a coarse powder with a size of about 50 μm to about 1,000 μm. Subsequently, this coarse powder is finely pulverized with a jet mill, for example, thereby obtaining a material powder that has a mean particle size of less than about 20 μm.

For safety considerations, the material powder to handle preferably has a mean particle size of at least about 1 μm. This is because if the mean particle size were less than about 1 μm, the material powder would react with oxygen in the air more easily and would be more likely to generate too much heat or start a fire due to oxidation. To handle the material powder more easily, the material powder preferably has a mean particle size of about 3 μm or more.

The mean particle size of the conventional HDDR magnet powder exceeds about 20 μm and usually falls within the range of about 50 μm to about 500 μm. The present inventors discovered and confirmed via experiments that if a material powder with such a large mean particle size were subjected to the HDDR process, the resultant magnetic properties would be either insufficient especially in terms of coercivity and loop squareness of demagnetization curve or even extremely poor. The magnetic properties would deteriorate due to the loss of homogeneity of reactions during the HDDR process (and during the HD reaction among other things). The greater the size of powder particles, the more easily the reactions would lose its homogeneity. If the HDDR reactions advanced non-homogenously, then the texture and crystal grain size could be non-homogenous or non-uniform, or unreacted portions could be created, inside the powder particles, thus resulting in deteriorated magnetic properties.

To advance the HDDR reactions uniformly, it is effective to shorten the time for completing the HDDR reactions. However, if the reaction rate were increased by adjusting the hydrogen pressure, for example, then the degree of alignment would vary among crystals, thus decreasing the anisotropy of the magnet powder. As a result, good loop squareness could not be achieved.

According to a preferred embodiment of the present invention, a material powder, of which the mean particle size is in the range of about 1 μm to less than about 20 μm, is used. That is why the hydrogen gas can easily diffuse to reach the inside of the powder while reacting, and the HD and DR reactions can be advanced in a short time, thus homogenizing the texture that has gone through the HDDR process. As a result, good magnetic properties (excellent loop squareness, among other things) are achieved and the HDDR process can get done in a shorter time.

Compaction of Material Powder

Next, the material powder described above is compacted to make a powder compact. The process of making the powder compact is preferably carried out under a magnetic field of about 0.5 T to about 20 T (such as a static magnetic field or a pulse magnetic field) with a pressure of about 10 MPa to about 200 MPa applied, for example. This compaction process may be performed using a known powder press machine. The powder compact that has just been unloaded from the powder press machine has a green density (compacted density) of about 3.5 g/cm$^3$ to about 5.2 g/cm$^3$. According to a preferred embodiment of +the present invention, the powder compact, obtained by compressing the material powder, is subjected to the HDDR process. However, since there are gaps that are large enough to pass and diffuse the hydrogen gas easily between the powder particles of the powder compact, the variation in the degree of the HDDR reaction among the particles of the material powder can be reduced. As a result, excellent magnetic properties (and good loop squareness, among other things) are achieved and the HDDR process can get done in a short time, too.

In addition, according to this preferred embodiment, the alignment and retentivity problems of a conventional anisotropic bonded magnet to be produced with an HDDR powder can also be overcome and radial or polar anisotropy can be given to the magnet as well.

This compaction process may be carried out without applying a magnetic field. If no magnetic field alignment were carried out, an isotropic microcrystalline high-density magnet would be obtained eventually. To achieve better magnetic properties, however, the compaction process is preferably carried out with magnetic field alignment such that an anisotropic microcrystalline high-density magnet is obtained in the end.

The process of pulverizing the starting alloy and the process of compacting the material powder are preferably carried out with the oxidation of the rare-earth element minimized to prevent the content of the extra rare-earth element R' in the magnet just before the HD process from being less than 0 at %. To reduce the oxidation of the material powder, the respective processes and handling between the respective processes are preferably carried out in an inert atmosphere in which the concentration of oxygen is reduced as much as possible. Optionally, a commercially available powder, of which the content of R' is equal to or greater than a predetermined value, may be purchased and the atmosphere may be controlled during the respective processes to be performed after that and during handling between those processes.

Also, for the purpose of improving the magnetic properties or for any other purpose, a mixture of the starting alloy yet to be pulverized and another alloy may be finely pulverized and then the fine powder may be compacted into a powder compact. Alternatively, after the starting alloy has been finely pulverized, the fine powder may be mixed with a powder of another metal, alloy and/or compound and the mixture may be compacted into a powder compact. Still alternatively, the powder compact may be dipped in a solution in which a metal, alloy and/or compound is/are dispersed or dissolved and then the solvent may be vaporized off. When any of these alternative methods is adopted, the composition of the alloy powder preferably falls within the ranges described above as a mixed powder.

HDDR Process

Next, the powder compact (or green compact) obtained by the compaction process is subjected to the HDDR process.

According to this preferred embodiment, even if the material powder particles cracked during the compaction process, the magnetic properties would not be affected because the powder particles are subjected to the HDDR process after that.

The conditions of the HDDR process are set appropriately according to the composition of the alloy and the types and amounts of the additive elements and may be determined by reference to the process conditions of the conventional HDDR process. In this preferred embodiment, a powder compact of powder particles with a relatively small mean particle size of about 1 μm to about 20 μm is preferably used, and therefore, the HDDR reactions can be completed in a shorter time than the conventional HDDR process. To complete the HDDR reactions in an even shorter time and more uniformly, the mean particle size is more preferably about 10 μm or less, even more preferably about 7 μm or less. On top of that, it is also effective to reduce the mean particle size to about 10 μm or less in order to handle the powder compact more easily before the HDDR process, to further increase the density by the densification heat treatment process of preferred embodiments of the present invention, and to handle more easily the different material to be introduced into the porous material obtained by the HDDR process as will be described later.

The temperature increasing process step to produce the HD reactions may be carried out in a hydrogen gas atmosphere with a hydrogen partial pressure of about 1 kPa to about 500 kPa, a mixed atmosphere of hydrogen gas and an inert gas (such as Ar or He), an inert gas atmosphere or a vacuum. If the temperature increasing process step is carried out in an inert gas atmosphere or in a vacuum, the following effects will be achieved:

(1) The collapse of the powder compact, which could be caused by hydrogen occlusion during the temperature increasing process step, can be avoided; and (2) The deterioration in magnetic properties, which could be caused due to difficulty in controlling the reaction rate during the temperature increase, can be reduced.

The HD process is carried out within either a hydrogen gas atmosphere or a mixture of hydrogen gas and inert gas (such as Ar or He) with a hydrogen partial pressure of about 1 kPa to about 500 kPa at a temperature of approximately 550° C. to less than approximately 1,000° C. During the HD process, the hydrogen partial pressure is more preferably about 1 kPa to about 200 kPa, even more preferably about 10 kPa to about 100 kPa to further control the reaction rate and minimize the decrease in anisotropy due to the HDDR process. The process temperature is more preferably about 600° C. to about 900° C. to control the crystal grain size and the reaction rate. The time for getting the HD process done may be about 5 minutes to about 10 hours, and is typically defined within the range of about 10 minutes to about 5 hours, for example. In this preferred embodiment, the material powder has a small mean particle size, and therefore, the HD reactions can be completed in a relatively short time and at a relatively low hydrogen partial pressure.

If in T of the R-T-Q based alloy, Co accounts for about 3 at % or less of the entire alloy, the partial pressure of hydrogen during the temperature increasing process step and/or the HD process is preferably about 5 kPa to about 100 kPa and more preferably about 10 kPa to about 50 kPa. Then, the decrease in anisotropy that could be caused by the HDDR process can be minimized. To achieve excellent properties by producing the HD reactions more properly, it is naturally possible to adopt some other measure such as changing the partial pressures of hydrogen stepwise during the HD process.

The HD process is followed by the DR process. The HD and DR processes may be carried out either continuously in the same system or discontinuously using two different systems.

The DR process is usually performed within either a vacuum or an atmosphere with a low partial pressure of hydrogen of about 10 kPa or less (e.g., an inert gas atmosphere) at a temperature of about 550° C. to less than about 1,000° C. The process time is appropriately determined by the process temperature but is normally about 5 minutes to about 10 hours and is typically defined within the range of about 10 minutes to about 2 hours. Optionally, the atmosphere could be naturally controlled in a stepwise manner (e.g., the hydrogen partial pressure or the reduced pressure could be further reduced step by step). By performing such an HDDR process, the powder compact introduced can be processed into a porous material including fine crystal grains, of which the density is about 50% to about 90% of the true density and which has an average crystal grain size of about 0.01 μm to about 2 μm.

The DR process is followed by a densification heat treatment process. The HD process, the DR process and the densification heat treatment process may be carried out continuously in the same system but may also be performed discontinuously using mutually different systems. According to a preferred embodiment of the present invention, the densification heat treatment process refers to a process that is designed to increase the density with only the thermal energy applied without performing any hot compaction process such as hot pressing or pulse electric current sintering. Thus, according to a preferred embodiment of the present invention, there is no need to increase the density with external force, e.g., by pressing the uppermost surface of the powder compact with a press member.

After the HDDR process, the densification heat treatment process is carried out at a temperature of about 750° C. to less than about 1,000° C. within either a vacuum or an inert gas atmosphere. The higher the process temperature, the higher the density of the resultant microcrystalline high-density magnet can be. But typically, the process temperature is equal to or higher than about 800° C. As for the process time, the longer the process time, the higher the density, too. But normally the process time falls within the range of about 5 minutes to about 10 hours and typically, a microcrystalline high-density magnet, of which the density is about 93% or more of its true density, can be obtained by performing the heat treatment process for at least one hour. In an inert gas atmosphere (which may be He or Ar but may not be $N_2$ because $N_2$ would deteriorate the properties of rare-earth magnets), the pressure is normally about 500 kPa or less. And the atmosphere may include such a concentration of hydrogen as to avoid producing the disproportionation reaction. Typically, the pressure of the inert gas is more preferably about 100 kPa or less.

As a result of the sintering reaction occurring during the HDDR process and during the densification heat treatment process, the microcrystalline high-density magnet shrinks at a shrinkage rate (which is calculated as ((size of compact yet to be subjected to HDDR process−size of compact subjected to HDDR process)/size of compact yet to be subjected to HDDR process×100) of about 10% to about 30%. However, the anisotropy of shrinkage is not significant. Specifically, in this preferred embodiment, the shrinkage ratio (i.e., shrinkage rate in magnetic field direction/shrinkage rate in a direction that is perpendicular to both the die pressing direction and the magnetic field direction) is in the range of about 1.5 to about 2.5. That is why microcrystalline high-density magnets can be formed in various shapes that have been difficult to form for conventional sintered magnets (with a shrinkage ratio of typically two to three).

Since the overall HDDR process is carried out within an atmosphere with a reduced oxygen concentration, the content of the extra rare-earth element R' just before the HD process becomes approximately equal to, or greater than, the content of R' right after the DR process. That is why by measuring the content of R' right after the DR process, it can be confirmed that the R' value just before the HD process is equal to or greater than a desired value. Nevertheless, as the surface layer of the microcrystalline high-density magnet could be oxidized and turn into black by a very small content of oxygen or water contained in the atmosphere during the HDDR process, the content of R' right after the DR process is preferably measured after that oxidized surface layer has been removed.

According to this preferred embodiment, after the compaction process, the powder compact (green compact) is subjected to the HDDR process. That is to say, no powder compaction process is carried out after the HDDR process. That is why once the HDDR process is finished, the magnetic powder is never pulverized under a compacting pressure. As a result, higher magnetic properties are achieved compared to a bonded magnet obtained by compressing an HDDR powder. Consequently, according to this preferred embodiment, the loop squareness of the demagnetization curve improves, and therefore, good magnetization property and good thermal resistance are achieved at the same time.

In addition, according to this preferred embodiment, the alignment and retentivity problems of a conventional anisotropic bonded magnet to be produced with an HDDR powder can also be overcome and radial or polar anisotropy can be given to the magnet as well. Also, the present invention has nothing to do with the essentially low productivity of a hot compaction process, either.

Also, according to this preferred embodiment, a powder compact yet to be densified has its density increased while the HDDR reactions are advanced. That is why magnet cracking or hydrogen diffusion path blocking that could be caused due to a variation in volume through the HD or DR reaction and other problems would not arise often. Furthermore, since the density can be increased sufficiently by conducting a heat treatment process at a temperature of about 1,000° C. or less, the deterioration in magnetic properties due to an abnormal grain growth of crystal grains would be much less likely. On top of that, since the HDDR reactions advance almost simultaneously both at the surface and the inside of the powder compact, even a magnet of a large size can be made easily.

A microcrystalline high-density magnet produced by the method according to a preferred embodiment of the present invention includes as high a percentage of hard magnetic phases as a sintered magnet, and therefore, has very high magnetic properties. Also, as the magnet has a crystal grain size of about 0.01 μm to about 2 μm, almost no damage would be done even if the magnet were machined to a thickness of about 3 mm or less. Furthermore, a microcrystalline high-density magnet made by the process according to a preferred embodiment of the present invention has a higher temperature coefficient to maintain coercivity $H_{cJ}$, and therefore higher thermal resistance, than a sintered magnet with the same composition.

Besides, a microcrystalline high-density magnet according to a preferred embodiment of the present invention has a unique structure, which is formed by the use of a powder with a mean particle size of about 1 μm to less than about 20 μm as the material powder, as will be described later by way of specific examples. Hereinafter, it will be described with reference to FIGS. 8A and 8B why the microcrystalline high-density magnet according to a preferred embodiment of the present invention has such a structure. Plus it will also be described how the material structure changes by going through the HDDR process shown in FIG. 2.

Figure 8B:
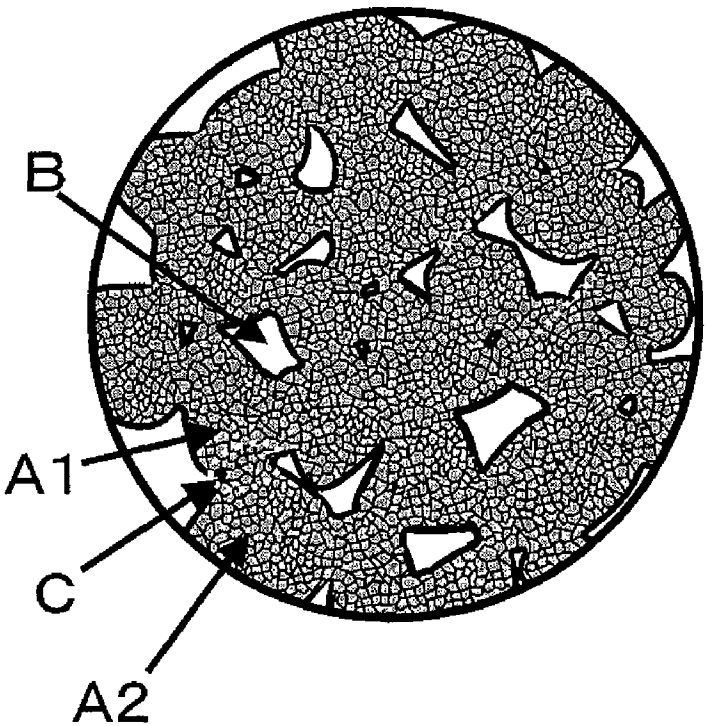
FIG. 8A is a schematic representation of a powder compact (green compact) yet to be subjected to HDDR processes and FIG. 8B is a schematic representation illustrating how the powder compact looks after having been subjected to the HDDR processes.
Figure 8A:
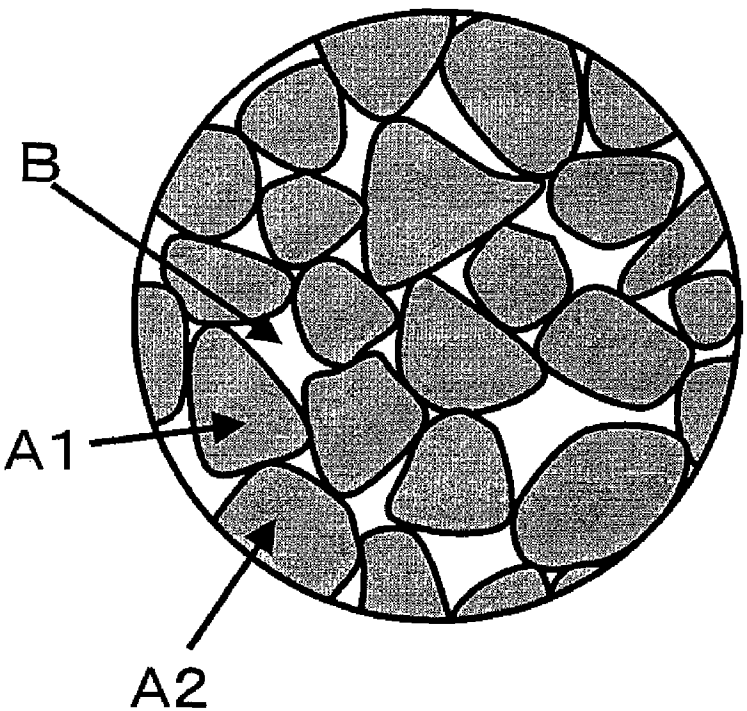

FIG. 8A is a schematic representation illustrating a powder compact (or a green compact) yet to be subjected to the HDDR process. The respective fine particles that constitute the powder have been compacted together by a compaction process. In this state, Particles A1 and A2 are in contact with each other. Also, the powder compact has a void B.

FIG. 8B is a schematic representation illustrating how this powder compact looks after having been subjected to the HDDR process. Each of the powder particles A1, A2 and so on has an aggregate structure consisting of fine $Nd_2Fe_{14}B$ type crystalline phases with an average crystal grain size of about 0.01 μm to about 2 μm as a result of the HDDR reactions. Each of these particles (e.g., Particle A1) forms a strong bond with another particle (e.g., Particle A2) due to the diffusion of elements as a result of the HDDR reactions. In FIG. 8B, the bonding portion between Particles A1 and A2 is identified by the reference sign C.

The void B that was present inside the powder compact either shrinks or disappears as shown in FIG. 8B as the sintering process advances with the diffusion of elements. However, densification cannot be done completely by the HDDR process but some "micropores" remain even after the HDDR process. In FIG. 8B, only $Nd_2Fe_{14}B$ type crystalline phases with an average crystal grain size of about 0.01 μm to about 2 μm are illustrated as the aggregate structure. But the aggregate structure may further include rare-earth rich phases and other phases as well.

Figure 6A:
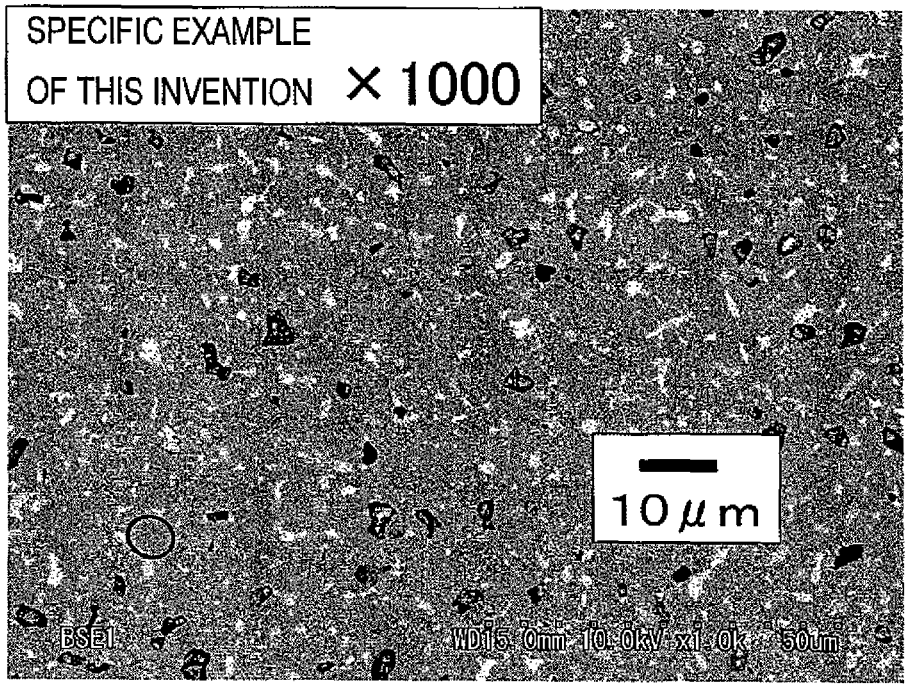
FIG. 6A is an SEM photograph (BSE image) showing a polished surface of a microcrystalline high-density magnet as a specific example of a preferred embodiment of the present invention.
Figure 6B:
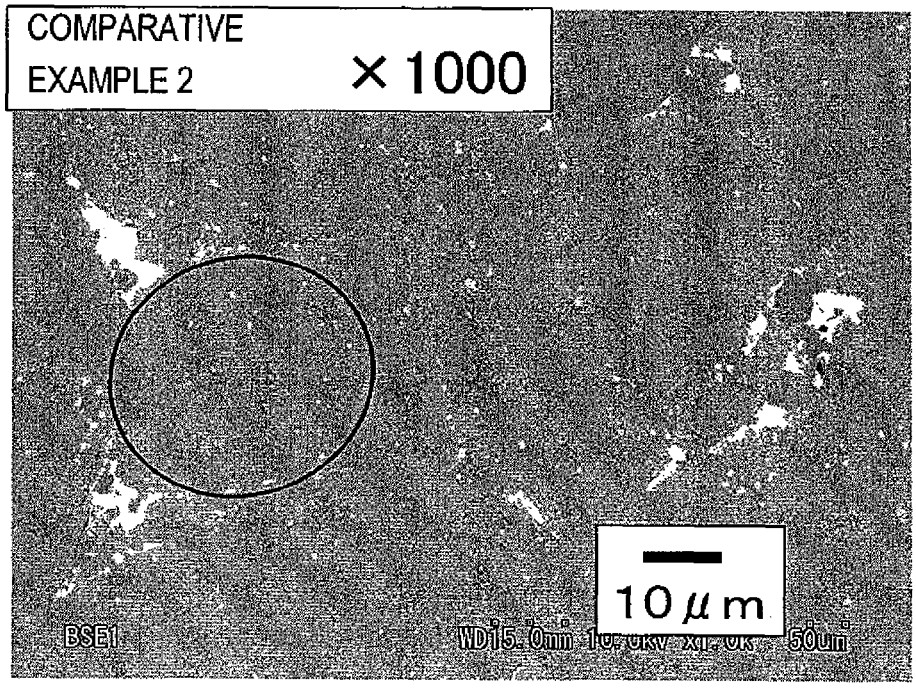
FIG. 6B is an SEM photograph (BSE image) showing a polished surface of Comparative Example 2.

During the subsequent densification heat treatment process, rare-earth-rich phases that have been present mostly on the surface of the material powder turn into liquid phases, thus producing a liquid phase sintering reaction and further advancing the shrinkage. As a result, a structure in which a huge number of rare-earth-rich phase blocks (e.g., blocks with sizes of about 1 $\mu m^2$ to about 10 $\mu m^2$, among other things) are dispersed finely is formed as shown in the photograph of FIG. 6A. The image shown in FIG. 6A was shot by polishing an arbitrary cross section of the microcrystalline high-density magnet according to a preferred embodiment of the present invention (e.g., a cross section passing through the center portion of the magnet) and observing its structure as a backscattered electron image with a scanning electron microscope (SEM). During this shrinkage process, the liquid phases aggregate together inside the voids B between the powder particles, thereby producing shrinkage driving force. After having gone through such a shrinkage process, the microcrystalline high-density magnet eventually has a rare-earth-rich phase at a location corresponding to the void B between the powder particles of the start material as shown in FIG. 6A. Also, these rare-earth-rich phases include a lot of portions with sizes of about 1 $\mu m^2$ to about 10 $\mu m^2$. Since these rare-earth-rich phases are produced during the densification process as described above, a portion surrounded with those rare-earth-rich phases (e.g., the encircled portion in FIG. 6A) has something to do with the size of the particles that form the original material powder. Meanwhile, the sample that was obtained by subjecting the conventional HDDR magnetic powder (with a mean particle size of at least about 20 μm, typically about 50 μm) to a hot press process has just a small number of rare-earth-rich phase blocks (e.g., blocks with sizes of about 1 $\mu m^2$ to about 10 $\mu m^2$, among other things) and a has a coarsely dispersed structure as shown in FIG. 6B. This means that the respective particles forming the original material powder have a large size as indicated in the encircled portion in FIG. 6B.

A microcrystalline high-density magnet according to a preferred embodiment of the present invention includes rare-earth-rich phases at a density (i.e., the number per unit area) of at least about $1.2\times10^5$ phase blocks per square millimeter on a cross section that passes a center portion of the magnet. Also, rare-earth-rich phases with a cross-sectional area of about 1 $\mu m^2$ to about 10 $\mu m^2$ are included at a density of at least about $1.6\times10^4$ phase blocks per square millimeter.

In this description, the number of the rare-earth-rich phase blocks per unit area (i.e., the density) is supposed to be estimated as follows. First, a cross section passing a center portion of a magnet, which has been worked with a cross section polisher SM-09010 (produced by JEOL, Ltd.) under conditions including about 4 kV and about 6 mA, has a backscattered electron image taken with a field emission scanning electron microscope (FE-SEM) at a magnification of 1,000×. Next, a backscattered electron image thus obtained with a vision of about 80 μm square, for example, is subjected to averaging processing and binarization processing using an image processing software program WinROOF (produced by Mitani Corporation). As a result of the binarization processing, the magnet is classified into portions with relatively high rare-earth concentrations (i.e., rare-earth rich phases) and portions with relatively low rare-earth concentrations (i.e., constituent phases other than the rare-earth-rich phases). Then, the rare-earth-rich phases are extracted from the binarized image thus obtained and the number of phases with areas of at least about 10 $mm^2$ is counted, thereby figuring out the number of rare-earth-rich phase blocks per unit area.

As for samples of microcrystalline high-density magnets, by extracting rare-earth-rich phases with areas of about 1 $\mu m^2$ to about 10 $\mu m^2$ from the binarized image and calculating the number of such phase blocks per unit area as the density, it can be determined appropriately whether or not the manufacturing process of a preferred embodiment of the present invention has been applied. As used herein, the "rare-earth-rich phases" according to preferred embodiments of the present invention refer to areas where the atomic percentage of the rare-earth elements is higher than in the main phase (i.e., $Nd_2Fe_{14}B$ type compound phase). Thus, areas with a higher luminance (which become white areas) than the main phase areas are extracted from the backscattered electron image obtained with an image processing software program.

Furthermore, according to this preferred embodiment, in the final aggregate structure of crystalline phases, crystal grains that have b/a ratios of less than two account for at least about 50 vol % of all crystal grains. As used herein, the b/a ratio is the ratio of the largest size b of each $Nd_2Fe_{14}B$ type crystalline phase (or fine crystal grain) to the smallest size a thereof. In this respect, the magnet of this preferred embodiment is quite different from a plastically processed magnet. The crystal structure of the plastically processed magnet consists mostly of flat crystal grains with the b/a ratios (i.e., the ratio of the largest size b to the smallest size a) of more than two.

Optionally, the microcrystalline high-density magnet obtained by the present invention may be pulverized into powder, which may then be used as a material powder to make a bonded magnet, for example.

Introduction of Different Material into Porous Magnet

The micropores of the R—Fe—B based porous material obtained by performing a series of manufacturing process steps according to a preferred embodiment of the present invention described above halfway through the HDDR process communicate with the air even in their deepest portions, and a different material may be introduced into the pores. If a composite bulk material is further subjected to a densification heat treatment process after such a different material has been introduced into the pores, the magnetic properties of the resultant microcrystalline high-density magnet can be improved eventually. The different material may be introduced by either a dry process or a wet process. Examples of the different materials include rare-earth metals, rare-earth alloys and/or rare-earth compounds, iron and alloys thereof.

Hereinafter, a specific preferred embodiment of the present invention will be described as to how such a different material may be introduced into the porous material before the densification heat treatment process is carried out.

(1) Introduction of Different Material by Wet Process

Examples of wet processes that can be performed on an R—Fe—B based porous material include electroplating process, electroless plating process, chemical conversion process, alcohol reduction process, carbonyl metal decomposition process, and sol-gel process. According to any of these processes, the surface of the porous material inside the micropores can be covered with a coating or layer of fine particles through chemical reactions. Alternatively, the wet process of a preferred embodiment of the present invention may also be performed even by providing a colloidal solution in which fine particles are dispersed in an organic solvent and dipping the pores of the R—Fe—B based porous material with the solution. In that case, the micropores can be coated with a layer of the fine particles that have been dispersed in the colloidal solution by vaporizing the organic solvent of the colloidal solution that has been introduced into the micropores of the porous material. When a wet process is performed as any of these processes, heating or ultrasonic wave application may be performed as an additional process to promote the chemical reactions or impregnate the porous material with the fine particles just as intended even in its deepest portions.

Hereinafter, a wet process that uses a colloidal solution will be described in detail.

The fine particles to be dispersed in the colloidal solution may be made by a known process that may be either a vapor phase process such as a plasma CVD process or a liquid phase process such as a sol-gel process. If the fine particles are made by a liquid phase process, its solvent may or may not be the same as that of the colloidal solution.

The fine particles preferably have a mean particle size of about 100 nm or less. This is because if the mean particle size exceeded about 100 nm, it would be difficult to impregnate the R—Fe—B based porous material with the colloidal solution to the deepest portions thereof. Meanwhile, the lower limit of the particle sizes of the fine particles is not particularly defined as long as the colloidal solution can keep stability. In general, if the particle size of the fine particles were less than about 5 nm, the stability of a colloidal solution would decrease often. That is why the particle size of the fine particles is preferably at least equal to about 5 nm, for example.

The solvent to disperse the fine particles in may be appropriately selected according to the particle size or a chemical property of the fine particles. However, as the R—Fe—B based porous material does not have such high corrosion resistance, a non-aqueous solvent is preferably used. Optionally, to prevent the fine particles from coagulating, the colloidal solution may include a disperser such as a surfactant.

The concentration of the fine particles in the colloidal solution may be determined appropriately by the particle size or a chemical property of the fine particles or the type of solvent or the disperser. The fine particles may have a concentration of about 1 mass % to about 50 mass %, for example.

If a rare-earth porous material is immersed in such a colloidal solution, the colloidal solution will penetrate even into the micropores deep inside the rare-earth porous material through a capillarity phenomenon. To impregnate the inside of the porous material with the colloidal solution more perfectly, it is effective to remove the air that is present inside the micropores of the porous material. That is why the impregnation process is preferably carried out by creating either a reduced pressure atmosphere or a vacuum once and then raising the pressure back to, or even beyond, a normal pressure.

In the porous material yet to be subjected to the impregnation process, debris of a machining process such as grinding might fill the micropores on the surface of the porous material, thus possibly interfering with perfect impregnation. For that reason, before the impregnation process, the surface of the porous material is preferably cleaned by ultrasonic cleaning, for example.

After the porous material has been subjected to the impregnation process, the solvent of the colloidal solution is vaporized. The vaporization rate of the solvent changes according to the type of the solvent. Some solvent can be vaporized sufficiently at room temperature and in the air. However, the vaporization is preferably accelerated by heating the colloidal solution and/or reducing the pressure as needed.

The material introduced by the wet process does not have to fill the micropores entirely but just needs to be present on the surface of the micropores. However, the material preferably covers the surface of the micropores to say the least.

Hereinafter, it will be described, as a specific example of preferred embodiments of the present invention, how to form a coating of Ag particles on the surface of micropores of a porous material using a colloidal solution in which the Ag particles are dispersed.

Specifically, a porous material, which was made by the method to be described later for a fifth specific example of a preferred embodiment of the present invention so as to have approximate dimensions of 7 mm×7 mm×5 mm, was subjected to ultrasonic cleaning and then immersed in a nanoparticle dispersed colloidal solution. This colloidal solution was Ag Nanometal Ink (produced by Ulvac Materials, Inc.) in which the Ag particles had a mean particle size of about 3 μm to about 7 μm and of which the solvent was tetradecane and the solid matter concentration was about 55 mass % to about 60 mass %. The nanoparticle dispersed colloidal solution was put into a glass container, which was then loaded into a vacuum desiccator with the porous material immersed in the solution and put under a reduced pressure. During the process, the atmospheric gas pressure was adjusted to about 130 Pa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to about 200° C. under an atmospheric gas pressure of about 130 Pa, thereby vaporizing the solvent and drying the material. In this manner, a sample of a composite bulk material according to a preferred embodiment of the present invention was obtained.

Also, as long as the situation permits, this series of process steps (and the drying process step among other things) is preferably carried out in an inert gas such as Argon gas (or in a vacuum if possible) to prevent the porous material with a big surface area from being oxidized.

Figure 3:
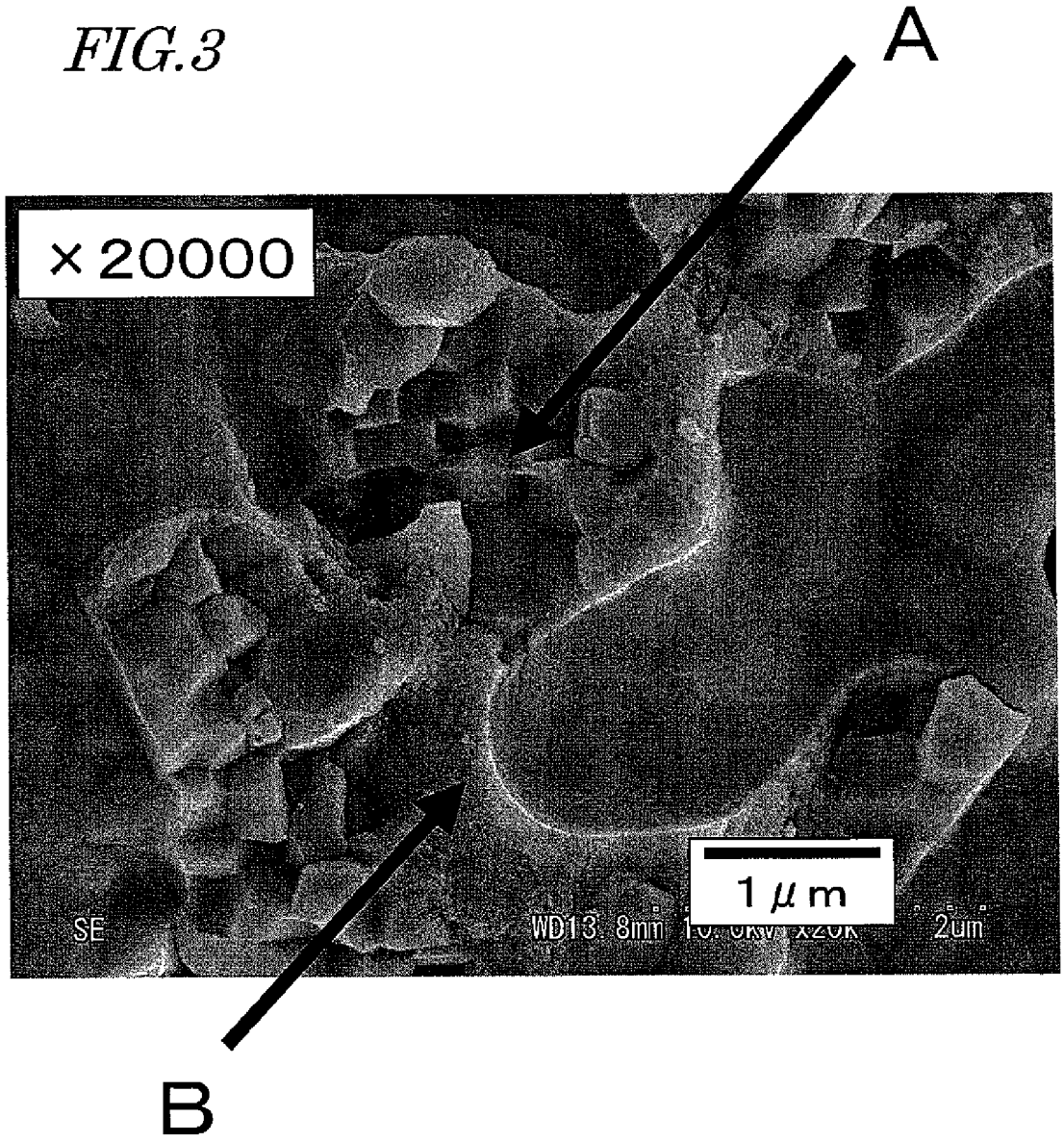
FIG. 3 is an SEM photograph showing a fractured surface of a porous material that has been subjected to a wet process.

FIG. 3 is an SEM photograph showing a fractured surface of the porous material (composite bulk material) that was already subjected to the impregnation process.

In the photograph shown in FIG. 3, the region A is the fractured surface of the porous material and the region B is a micropore, of which the surface is covered with a coating that is filled with fine particles with sizes of several to several tens of nanometers. This coating of fine particles would have been formed by the Ag nanoparticles, which had been dispersed in the nanoparticle dispersed colloidal solution, transported along with the solvent through the micropores of the porous material, and then left in the micropores even after the solvent was vaporized. Such a coating of Ag nanoparticles was observed at the core of the sample, too.

In this manner, the fine particles can be introduced to the core of the porous material through the micropores thereof.

Optionally, such an R—Fe—B based porous material, in which a different material from the R—Fe—B based porous material has been introduced into the micropores by a wet process, may be further subjected to a heating process to improve the properties thereof. The temperature of the heating process is appropriately set according to the purpose of the heating process. However, if the temperature of the heating process were equal to or higher than 1,000° C., the size of the aggregate structure in the R—Fe—B based porous material would increase too much to maintain good magnetic properties. For that reason, the temperature of the heating process is preferably less than about 1,000° C. The heating atmosphere is preferably either a vacuum or an inert gas such as Ar gas in order to prevent the magnetic properties of the R—Fe—B based porous material from deteriorating due to oxidation or nitrification.

It should be noted that the introduction of the different material by the wet process does not always have to be carried out continuously with the HD process, the DR process or the densification heat treatment process. Optionally, a metal, an alloy and/or a compound may be introduced as a different material into the HD processed powder compact, which may then be subjected to the DR process and the densification heat treatment process. In that case, the mutual diffusion and bonding of particles will have advanced in the HD processed powder compact, which will be easier to handle than a powder compact yet to be subjected to the HD process. For that reason, a metal, an alloy and/or a compound can be easily introduced into such an HD processed powder compact.

A method of introducing a different material by a wet process has been described. However, to introduce a rare-earth element as the different material, the following method is preferably adopted.

(2) Introducing Rare-Earth Element

The rare-earth metal, rare-earth alloy or rare-earth compound to be introduced onto the surface and/or into the micropores of the R—Fe—B based porous material is not particularly limited as long as it includes at least one rare-earth element. To achieve the effects and advantages of preferred embodiments of the present invention significantly, however, it preferably includes at least one of Nd, Pr, Dy and Tb.

There are various methods for introducing at least one of rare-earth metals, rare-earth alloys, and rare-earth compounds onto the surface and/or into the micropores of the R—Fe—B based porous material and the present invention is in no way limited to any one of them. Those introducing methods available are roughly classifiable into dry processes and wet ones. Hereinafter, these two types of methods will be described specifically.

(A) Dry Processes

Examples of known dry processes adoptable include physical vapor deposition processes such as a sputtering process, a vacuum evaporation process and an ion plating process. Alternatively, a powder of at least one of rare-earth metals, rare-earth alloys and rare-earth compounds (such as hydrides) may be mixed with an R—Fe—B based porous material, and the mixture may be heated, thereby diffusing the rare-earth element into the R—Fe—B based porous material. Still alternatively, as disclosed in PCT/JP2007/53892 (corresponding to pamphlet of PCT International Application Publication No. WO 2007/102391), a method of diffusing a rare-earth element into an R—Fe—B based porous material while vaporizing and evaporating the element from a rare-earth containing material (which is so-called an "evaporation/diffusion process") may also be adopted.

The temperature of the porous material during the dry process may be room temperature or may have been increased by heating. However, if the temperature were equal to or higher than about 1,000° C., the aggregate structure in the R—Fe—B based porous material would increase its size too much to avoid deterioration in magnetic properties. For that reason, the temperature of the porous material during the dry process is preferably less than about 1,000° C. By adjusting the temperature and process time of the dry process appropriately, it is possible to prevent the aggregate structure from growing coarsely. Depending on the condition of such a heat treatment, the porous material could get even denser. However, if the heat treatment is carried out to prevent the aggregate structure from growing coarsely, micropores will remain in the porous material. That is why it has been believed that to increase the density of the porous material fully, the porous material should be heat-treated while being pressed. According to a preferred embodiment of the present invention, by setting the heat treatment temperature and process time appropriately, the density can be increased to about 93% or more of the true density while preventing the aggregate structure from growing coarsely.

The atmosphere for the dry process may be appropriately selected according to the specific type of the process to perform. If oxygen or nitrogen were included in the atmosphere, the magnetic properties might deteriorate due to oxidation or nitrification during the process. In view of this consideration, the dry process is preferably performed in either a vacuum or an inert atmosphere (such as argon gas).

(B) Wet Processes

As the wet process, an appropriate one of the known processes mentioned above may also be performed. Among other things, a method of impregnating the pores of an R—Fe—B based porous material with a solution prepared by dispersing fine particles in an organic solvent (which will be referred to herein as a "process solution") is particularly preferred. In that case, the micropores can be coated with a layer of the fine particles that have been dispersed in the process solution by vaporizing the organic solvent of the colloidal solution that has been introduced into the micropores of the porous material. When a wet process is performed as any of these processes, heating or ultrasonic wave application may be performed as an additional process to promote the chemical reactions or impregnate the porous material with the fine particles just as intended even in its deepest portions.

The fine particles to be dispersed in the process solution may be made by a known process that may be either a vapor phase process such as a plasma CVD process or a liquid phase process such as a sol-gel process. If the fine particles are made by a liquid phase process, its solvent (dispersion medium) may or may not be the same as that of the process solution.

The fine particles to be dispersed in the process solution preferably include at least one of rare-earth oxides, fluorides and fluoride oxides. Particularly if a fluoride or a fluoride oxide is used, the rare-earth element can be diffused efficiently in the grain boundary of crystal grains that form the porous material by the heating process to be described later, thus achieving significant effects and advantages of preferred embodiments of the present invention.

The fine particles preferably have a mean particle size of about 1 μm or less. This is because if the mean particle size exceeded about 1 μm, it would be difficult to disperse the fine particles in the process solution or to impregnate the R—Fe—B based porous material with the process solution to the deepest portions thereof. The mean particle size is more preferably about 0.5 μm or less and even more preferably about 0.1 μm (=100 nm) or less. The lower limit of the particle sizes of the fine particles is not particularly defined as long as the process solution can keep stability. In general, if the particle size of the fine particles were less than about 1 nm, the stability of a process solution would decrease often. That is why the particle size of the fine particles is preferably at least equal to about 1 nm, more preferably 3 nm or more, and even more preferably about 5 nm or more.

The solvent (dispersion medium) to disperse the fine particles in may be appropriately selected according to the particle size or a chemical property of the fine particles. However, as the R—Fe—B based porous material does not have such high corrosion resistance, a non-aqueous solvent is preferably used. Optionally, to prevent the fine particles from coagulating, the process solution may include a disperser such as a surfactant or the fine particles may be subjected to a surface treatment in advance.

The concentration of the fine particles in the process solution may be determined appropriately by the particle size or a chemical property of the fine particles or the type of solvent or the disperser. The fine particles may have a concentration of about 1 mass % to about 50 mass %, for example.

If a rare-earth porous material is immersed in such a process solution, the process solution will penetrate even into the micropores deep inside the rare-earth porous material through a capillarity phenomenon. To impregnate the inside of the porous material with the process solution more perfectly, it is effective to remove the air that is present inside the micropores of the porous material. That is why the impregnation process is preferably carried out by creating either a reduced pressure atmosphere or a vacuum once and then raising the pressure back to, or even beyond, a normal pressure.

In the porous material yet to be subjected to the impregnation process, debris of a machining process such as grinding might fill the micropores on the surface of the porous material, thus possibly interfering with perfect impregnation. For that reason, before the impregnation process, the surface of the porous material is preferably cleaned by ultrasonic cleaning, for example.

After the porous material has been subjected to the impregnation process, the solvent (dispersion medium) of the process solution is vaporized. The vaporization rate of the solvent changes according to the type of the solvent. Some solvent can be vaporized sufficiently at room temperature and in the air. However, the vaporization is preferably accelerated by heating the process solution and/or reducing the pressure as needed.

The material introduced by the wet process does not have to fill the micropores entirely but just needs to be present on the surface of the micropores. However, the material preferably covers the surface of the micropores to say the least.

The introduction of the rare-earth element by the dry or wet process described above does not always have to be continuous with the HD process, the DR process or the densification heat treatment process. Optionally, the rare-earth element may be introduced by the same method as the one described above into the powder compact that has been subjected to the HD process and then the DR process and the densification heat treatment process may be carried out. In that case, in the powder compact that has been subjected to the HD process, the particles will have been diffused and joined together to considerable degrees, and such a powder compact will be much easier to handle than the powder compact yet to be subjected to the HD process. Then, a metal, an alloy and/or a compound can be easily introduced thereto.

Also, if the densification heat treatment process described above is applied to the porous material (composite bulk material) into which the rare-earth element has already been introduced by such a method, then a composite microcrystalline high-density magnet, of which the density has been increased to as high as about 93% or more of its true density, can be obtained.

To further increase the coercivity, a compound of a heavy rare-earth element such as Dy or Tb may be applied to, and then diffused inside, the microcrystalline high-density magnet according to a preferred embodiment of the present invention by the method disclosed in the pamphlet of PCT International Application Publication No. WO 2006/043348. Or a heavy rare-earth element may be introduced into, and diffused inside, the magnet according to a preferred embodiment of the present invention by the method disclosed in the pamphlet of PCT International Application Publication No. WO 2007/102391.

Optionally, the microcrystalline high-density magnet according to a preferred embodiment of the present invention may be subjected to some surface treatment in order to make the magnet corrosion resistant. Any appropriate surface treatment applicable to a normal sintered R—Fe—B based rare-earth magnet may be adopted. Examples of specific surface treatment processes include dry film deposition processes such as vacuum evaporation and ion plating, wet processes such as plating and chemical conversion process, and formation of a resin coating by electrodeposition application or spray application.

Furthermore, the microcrystalline high-density magnet obtained by the method described above may be pulverized into powder, which may then be used as a material powder to make a bonded magnet, for example.

EXAMPLE 1

An alloy with a composition such as the one shown in the following Table 1 was provided to make a microcrystalline high-density rare-earth permanent magnet by the manufacturing process that has been described above as preferred embodiments of the present invention. In Table 1, the unit of the numerical values is at %. Hereinafter, a method for producing a magnet according to a first specific example of the present invention will be described.

TABLE 1

| Alloy | Nd | Fe | Co | B | Al | Cu | Ga |
|---|---|---|---|---|---|---|---|
| A | 15.9 | Balance | 1.0 | 6.2 | 0.5 | 0.1 | 0.1 |

First, a rapidly solidified alloy having the composition shown in Table 1 was made by a strip casting process. The rapidly solidified alloy thus obtained was coarsely pulverized by a hydrogen occlusion decrepitation process into a powder with particle sizes of about 425 μm or less, and then the coarse powder was finely pulverized with a jet mill, thereby obtaining a fine powder with a mean particle size of about 4.1 μm. As used herein, the "mean particle size" refers to an approximately 50% volume center particle size ($D_{50}$) obtained by Laser Diffraction Particle Size Analyzer (HEROS/RODOS produced by Sympatec GmbH).

This fine powder was loaded into the die of a press machine. And under a magnetic field of about 1.5 tesla (T), a pressure of about 20 MPa was applied to the fine powder perpendicularly to the magnetic field, thereby making a powder compact. The density of the powder compact was calculated to be about 3.98 g/cm$^3$ based on the dimensions and weight.

Next, the powder compact was subjected to the HDDR process described above. Specifically, the powder compact was heated to about 880° C. within an argon gas flow at about 100 kPa (i.e., at the atmospheric pressure). After the atmospheres were changed into a hydrogen gas flow at about 100 kPa (i.e., at the atmospheric pressure), the powder compact was maintained at about 880° C. for about 30 minutes, thereby producing hydrogenation and disproportionation reactions. Thereafter, the powder compact was maintained at about 880° C. for about another 30 minutes within an argon gas flow at a reduced pressure of about 5.3 kPa to produce hydrogen desorption and recombination reactions. Subsequently, the powder compact was further maintained at about 880° C. for about 3 hours and 30 minutes within an argon gas flow at a reduced pressure of about 5.3 kPa, thereby performing a densification heat treatment process. And then the temperature was decreased to room temperature within an Ar gas flow at the atmospheric pressure to obtain a sample representing a specific example of a preferred embodiment of the present invention. An SEM photograph showing a fractured surface of the sample is shown in FIG. 1A. Also, another surface of the sample that was perpendicular to the alignment direction during the compaction process under a magnetic field was analyzed by an XRD analysis. As a result, it was confirmed that the sample had an $Nd_2Fe_{14}B$ type compound phase and its easy magnetization direction was aligned with the direction in which the magnetic field was applied during the compaction process.

A sample that had been cooled without being subjected to the densification heat treatment process (at about 880° C. for about 3 hours 30 minutes) was made separately and had its properties evaluated. As a result, it was confirmed that the sample was a porous material, of which the density was approximately 75% of its true density and which included fine crystal grains with an average crystal grain size of about 0.5 μm. Also, the constituent phases of the porous material were identified by an XRD analysis. As a result, it was confirmed that the hydrogen desorption and recombination (DR) reactions were completed by conducting the heat treatment at about 880° C. for about 30 minutes.

Figure 1B:
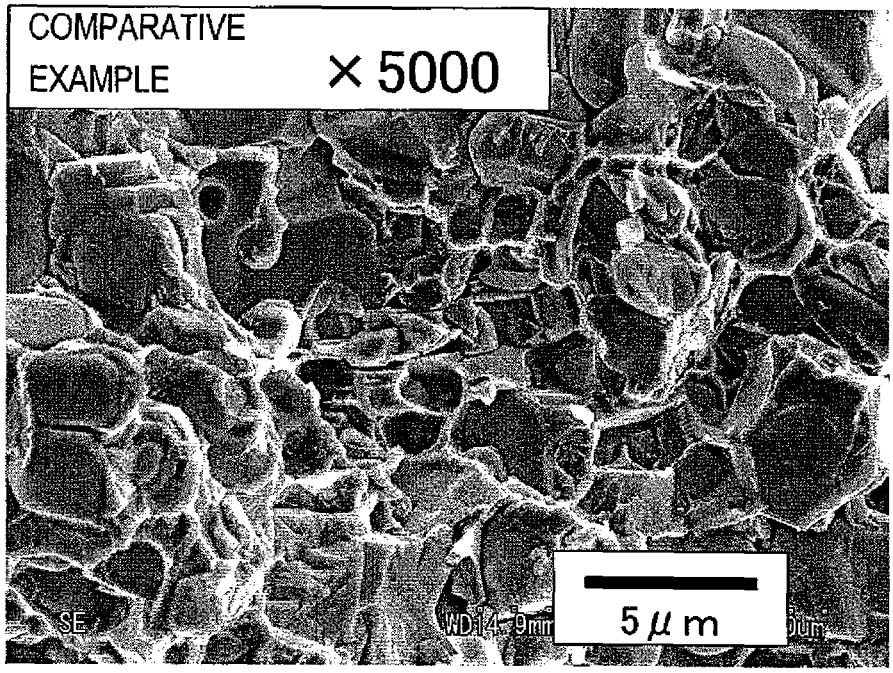
FIG. 1B is an SEM photograph showing a fractured surface of a microcrystalline high-density magnet as Comparative Example 1 for the present invention.
Figure 1C:
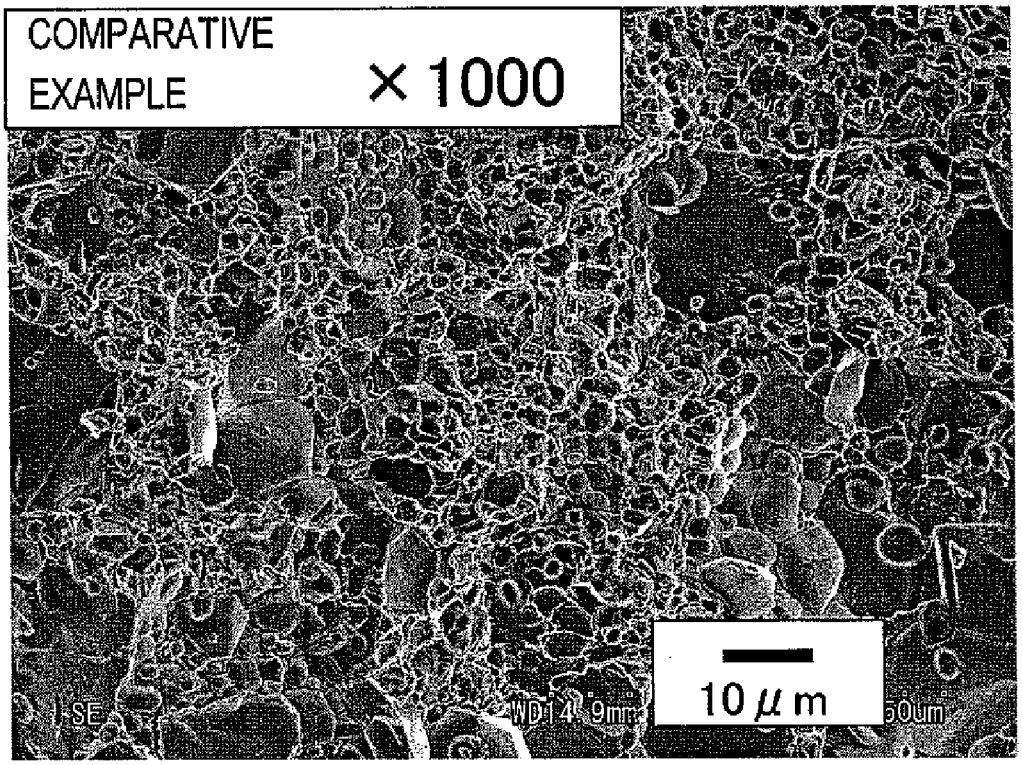
FIG. 1C is an SEM photograph showing a fractured surface of a microcrystalline high-density magnet as Comparative Example 1 for the present invention.

As Comparative Example 1, a powder compact was heated to about 880° C. within an argon gas flow at about 100 kPa (i.e., at the atmospheric pressure). After the atmospheres were changed into a hydrogen gas flow at about 100 kPa (i.e., at the atmospheric pressure), the powder compact was maintained at about 880° C. for about 30 minutes, thereby producing hydrogenation and disproportionation reactions. Thereafter, the powder compact was maintained at about 880° C. for another about 30 minutes within an argon gas flow at a reduced pressure of about 5.3 kPa to produce hydrogen desorption and recombination reactions. Subsequently, the sample was continuously heated in the same furnace to about 1,000° C. and maintained at about 1,000° C. for one hour within an argon gas flow at a reduced pressure of about 5.3 kPa, thereby performing a heat treatment process to increase the density. An SEM photograph showing a fractured surface of Comparative Example 1 is shown in FIGS. 1B and 1C. The only difference between the two photos shown in FIGS. 1B and 1C is zoom power. As can be seen easily from FIG. 1B, when heated to about 1,000° C., most of the crystal grains of the sample had grain sizes exceeding about 2 μm. Also, as is clear from FIG. 1C, some crystal grains with sizes exceeding about 10 μm were observed in the comparative example.

The dimensions of the sample thus obtained were measured and compared to those measured before the heating process. The shrinkage rates of the sample were calculated in the magnetic field direction and in the direction perpendicular to both the die pressing direction and the magnetic field direction and the shrinkage ratio was calculated 1.82. In this case, the shrinkage rate (%) is given by (size of sample yet to be heated−size of heated sample)÷size of sample yet to be heated×100, while the shrinkage ratio is given by (shrinkage rate in magnetic field direction/shrinkage rate in a direction perpendicular to both the die pressing direction and the magnetic field direction).

The concentration of oxygen in the sample that had just started to be subjected to the HD process was about 0.43 mass % and the content of extra rare-earth element R' was calculated to be about 5.58 at % based on Nd, Fe and Co shown in Table 1.

In the sample of this specific example, the HDDR process advances during the sintering process unlike a normal sintered magnet. As a result, an aggregate structure consisting of very fine crystalline phases with sizes of about 0.01 μm to about 2 μm is formed inside each powder particle.

Based on the dimensions and weight of the sample, the density of the sample was calculated to be about 7.15 g/cm$^3$. When the true density was supposed to be about 7.60 g/cm$^3$, the relative density of the sample was about 94.1%. On the other hand, the density of Comparative Example 1 was 7.47 g/cm$^3$. The sample that had been subjected to the grinding process and Comparative Example 1 were magnetized with a pulse magnetic field of 3.2 MA/m and then their magnetic properties were measured with a BH tracer MTR-1412 (produced by Metron, Inc.) The results are shown in the following Table 2. In the specific example of a preferred embodiment of the present invention, the coercivity $H_{cJ}$ was high enough to actually use the magnet in various applications, and therefore, $(BH)_{max}$ was also high. In Comparative Example 1 on the other hand, as the magnet had been heated to 1000° C., its density was high enough to achieve a high $J_{max}$ and a high $B_r$. However, as a lot of crystal grains had sizes exceeding 10 μm due to the abnormal grain growth, $H_{cJ}$ was as low as 200 kA/m or less. As a result, $(BH)_{max}$ decreased so significantly to actually use the magnet in various applications.

TABLE 2

| Sample | $J_{max}$ (T) | $B_r$ (T) | $(BH)_{max}$ (kJ/m$^3$) | $H_{cJ}$ (kA/m) | $H_k$ (kA/m) |
|---|---|---|---|---|---|
| Example 1 | 1.21 | 1.19 | 261 | 949 | 599 |
| Comparative Example 1 | 1.35 | 1.34 | 161 | 183 | 159 |

In Table 2, $J_{max}$ is the maximum value of magnetization J (T) of the magnetized sample when an external magnetic field H of up to 2 tesla (T) was applied to the sample in the magnetization direction, and $H_k$ is a value of the external magnetic field H when $B_r \times 0.9$.

Figure 4:
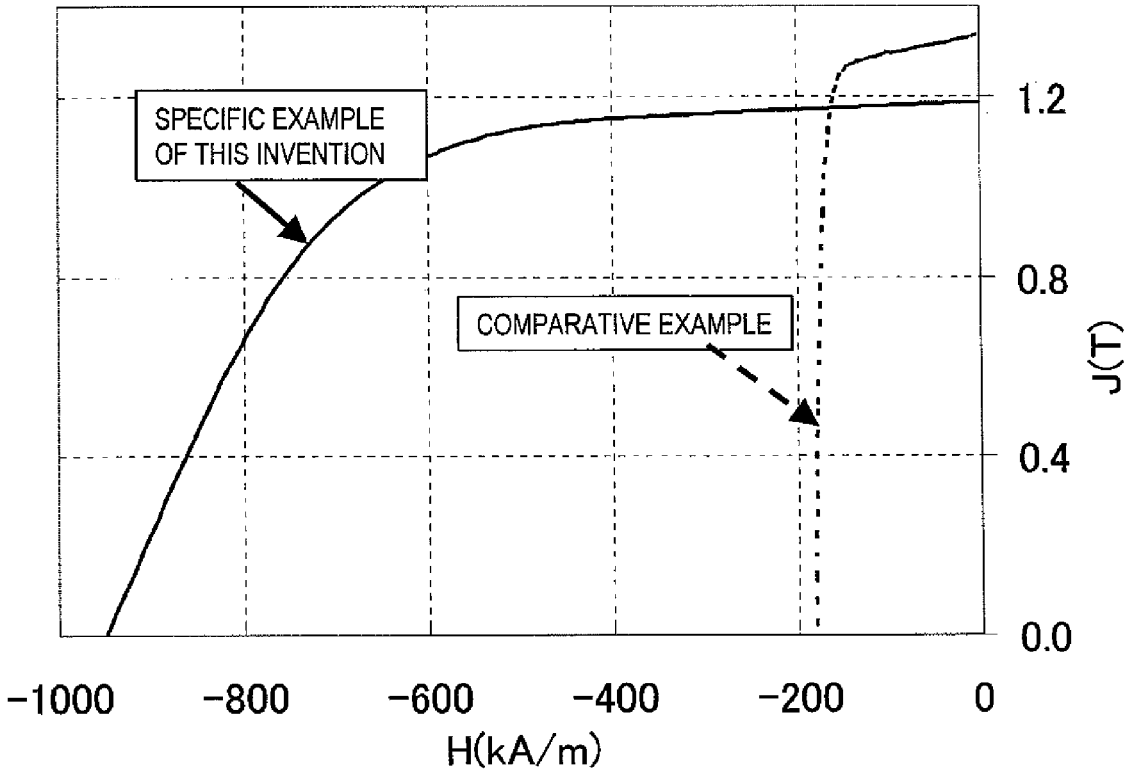
FIG. 4 is a graph showing the demagnetization curves (that are the second quadrant portions of hysteresis curves) of microcrystalline high-density magnets representing a specific example of a preferred embodiment of the present invention and Comparative Example 1.

FIG. 4 is a graph showing the demagnetization curves of this specific example of the present invention and Comparative Example 1. In FIG. 4, the ordinate represents the magnetization J and the abscissa represents the external magnetic field H.

EXAMPLE 2

Each of the samples obtained in Example 1 was cut and ground to as small a thickness as about 0.5 mm parallel to the alignment direction, magnetized with a pulse magnetic field of about 4.8 MA/m, and then had its magnetic properties measured with a vibrating sample magnetometer (VSM) (e.g., VSM5 produced by Toei Industry Co., Ltd). The results are shown in the following Table 3. In this case, the demagnetization curve of the specific example of a preferred embodiment of the present invention had no inflection point, which would be caused in a sintered magnet due to machining damage as will be described later, and $(BH)_{max}$ decreased by no more than about 2%. As a reference example, the results of measurements that were carried out with a BH tracer MTR-1412 (produced by Metron, Inc.) on a sample yet to be cut into thin pieces are also shown in the following Table 3:

TABLE 3

| Sample | $J_{max}$ (T) | $B_r$ (T) | $(BH)_{max}$ (kJ/m$^3$) | $H_{cJ}$ (kA/m) | $H_k$ (kA/m) |
|---|---|---|---|---|---|
| Example (already cut into thin pieces) | 1.21 | 1.19 | 258 | 940 | 585 |
| Reference example (yet to be cut) | 1.21 | 1.19 | 261 | 949 | 599 |

Meanwhile, as a comparative example, a normal sintered magnet was produced using Alloy A of Example 1 and machined into the same dimensions as that specific example of preferred embodiments of the present invention. Then, the magnetic properties of the sample were measured with a vibrating sample magnetometer (VSM) (e.g., VSM5 produced by Toei Industry Co., Ltd). As a result, an inflection point representing machining damage was identified on the demagnetization curve in the vicinity of an external magnetic field of about 100 kA/m. And it was confirmed that $(BH)_{max}$ decreased by about 10% or more. It was also confirmed that such an inflection point appeared at a thickness of about 1 mm or less. In the microcrystalline high-density magnet according to a preferred embodiment of the present invention, however, there was no noticeable degradation even when the magnet was machined to a thickness of about 0.5 mm.

These results revealed that even when machined to as small a thickness as about 3 mm or less (in particular, about 1 mm or less), the microcrystalline high-density magnet of a preferred embodiment of the present invention exhibited almost no degradation in magnetic properties unlike a normal sintered magnet.

EXAMPLE 3

Next, the microcrystalline high-density magnet of the first specific example of a preferred embodiment of the present invention described above was pulverized with a mortar within an argon atmosphere and then classified, thereby obtaining a powder with particle sizes of about 75 μm to about 300 μm. Then, this powder was loaded into a cylindrical holder and fixed with paraffin while being aligned with a magnetic field of about 800 kA/m. The sample thus obtained was magnetized with a pulse magnetic field of about 4.8 MA/m and then its magnetic properties were measured with a vibrating sample magnetometer (VSM) (e.g., VSM5 produced by Toei Industry Co., Ltd). It should be noted that no anti-magnetic field correction was made. The results are shown in the following Table 4:

TABLE 4

| Alloy | $J_{max}$ (T) | $B_r$ (T) | $(BH)_{max}$ (kJ/m$^3$) | $H_{cJ}$ (kA/m) |
|---|---|---|---|---|
| A | 1.19 | 1.12 | 188 | 859 |

In Table 4, $J_{max}$ and $B_r$ were calculated on the supposition that the sample had a true density of about 7.60 g/cm$^3$. It should be noted that $J_{max}$ is a value obtained by correcting the magnetization J (T) of the sample, which was measured when an external magnetic field H of about 2 tesla (T) was applied to the magnetized sample in its magnetization direction, in view of the mirror image effect of the VSM measurements. The magnet powder obtained by pulverizing the microcrystalline high-density magnet also exhibited good magnetic properties. Such a magnet powder can be used effectively to make a bonded magnet.

EXAMPLE 4

Alloy A used in Example 1 (which is shown again in the following Table 5) was subjected to the following experiment. Specifically, the material alloy was pulverized coarsely and then finely by the same methods as the ones used in Example 1, thereby obtaining a fine powder with a mean particle size of about 4.31 μm. As used herein, the "mean particle size" refers to an approximately 50% volume center particle size ($D_{50}$) obtained by Laser Diffraction Particle Size Analyzer (HEROS/RODOS produced by Sympatec GmbH).

TABLE 5

| Alloy | Nd | Fe | Co | B | Al | Cu | Ga |
|---|---|---|---|---|---|---|---|
| A | 15.9 | Balance | 1.0 | 6.2 | 0.5 | 0.1 | 0.1 |

Next, as shown in the following Table 6, the fine powder was compacted either under no magnetic field or with a magnetic field applied to obtain a powder compact with a density of about 3.98 g/cm$^3$. Then, the powder compact was subjected to various HDDR processes. Specifically, the powder compact was heated to about 880° C. within any of the temperature increasing atmospheres shown in Table 6. After the atmospheres were changed into another one of the atmospheres shown in Table 6, the powder compact was maintained at about 880° C. for any of the amounts of time shown in Table 6, thereby producing hydrogenation and disproportionation reactions. Thereafter, the powder compact was maintained at about 880° C. for about 30 minutes within an argon gas flow at a reduced pressure of about 5.3 kPa to produce hydrogen desorption and recombination reactions. Then the powder compact was further subjected to a densification heat treatment process by maintaining it at about 880° C. for about 3 hours and 30 minutes within an argon gas flow at a reduced pressure of about 5.3 kPa. And then the temperature was decreased to room temperature within an Ar gas flow at the atmospheric pressure to obtain samples representing specific examples of preferred embodiments of the present invention.

TABLE 6

| Alloy | Compacted with magnetic field? | Temperature increasing atmosphere | HD process atmosphere | HD process time | Experiment No. |
|---|---|---|---|---|---|
| A | NO | $H_2$ (atmospheric pressure) | $H_2$ (atmospheric pressure) | 30 min. | A-(1) |
| | YES | $H_2$ (atmospheric pressure) | $H_2$ (atmospheric pressure) | 30 min. | A-(2) |
| | YES | $H_2$ + Ar (2:1, atmospheric pressure) | $H_2$ + Ar (2:1, atmospheric pressure) | 30 min. | A-(3) |
| | YES | Ar (atmospheric pressure) | $H_2$ (atmospheric pressure) | 30 min. | A-(4) |
| | YES | Ar (atmospheric pressure) | $H_2$ + Ar (2:1, atmospheric pressure) | 30 min. | A-(5) |

TABLE 6-continued

| Alloy | Compacted with magnetic field? | Temperature increasing atmosphere | HD process atmosphere | HD process time | Experiment No. |
|---|---|---|---|---|---|
| | YES | Ar (atmospheric pressure) | $H_2$ + Ar (2:1, atmospheric pressure) | 1 hr. | A-(6) |
| | YES | Vacuum | $H_2$ (125 kPa (pressurized)) | 30 min. | A-(7) |

The present inventors confirmed that the fractured surface of each of these samples obtained consisted of an aggregate structure of fine crystals that had similar appearance to the one shown in FIG. 1A.

Next, the surface of the samples was worked with a surface grinder and the densities of the samples were calculated based on the dimensions and weight thereof after the grinding process. The relative densities were also calculated on the supposition that the true density was about 7.60 g/cm$^3$. The results are shown in the following Table 7. The samples that had been subjected to the grinding process were magnetized with a pulse magnetic field of about 3.2 MA/m and then their magnetic properties were measured with a BH tracer MTR-1412 (produced by Metron, Inc.) The results are shown in the following Table 7. In Table 7, $J_{max}$ is the maximum value of magnetization J (T) of the magnetized sample when an external magnetic field H of up to about 2 Tesla (T) was applied to the sample in the magnetization direction and $H_k$ is a value of the external magnetic field H when $B_r \times 0.9$ as in the first specific example described above.

TABLE 7

| Experiment No. | Density (g/cm$^3$) | Relative density (%) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|---|
| A-(1) | 7.20 | 94.7 | 0.71 | 978 | 83 | 0.80 | 0.34 |
| A-(2) | 7.21 | 94.9 | 0.79 | 897 | 96 | 0.87 | 0.42 |
| A-(3) | 7.15 | 94.1 | 1.24 | 480 | 237 | 0.96 | 0.68 |
| A-(4) | 7.30 | 96.1 | 1.19 | 949 | 261 | 0.98 | 0.63 |
| A-(5) | 7.15 | 94.1 | 1.28 | 328 | 229 | 0.99 | 0.87 |
| A-(6) | 7.24 | 95.3 | 1.22 | 916 | 276 | 0.99 | 0.62 |
| A-(7) | 7.13 | 93.8 | 1.02 | 950 | 196 | 0.96 | 0.56 |

Based on the results of these experiments, the present inventors confirmed that a microcrystalline high-density magnet with the appearance of preferred embodiments of the present invention could be obtained under any of these processing conditions. The present inventors also confirmed that if the powder compact (i.e., green compact) was made while being aligned with a magnetic field, the magnetic properties of the resultant magnet were better. The present inventors also discovered that by adopting either an inert gas or an atmosphere with a low hydrogen partial pressure as the temperature increasing atmosphere, $B_r/J_{max}$ (which is an index indicating the degree of alignment of the $Nd_2Fe_{14}B$ type compound phase) increased. In addition, the present inventors further discovered that when an atmosphere with a low hydrogen partial pressure was used as the HD process atmosphere, an even higher $B_r/J_{max}$ could be achieved and a microcrystalline high-density magnet with even better magnetic properties could be obtained.

EXAMPLE 5

Rapidly solidified alloys B through F, of which the target compositions are shown in the following Table 8, were made by a strip casting process. The rapidly solidified alloys thus obtained were coarsely pulverized, finely pulverized and then compacted under a magnetic field by the same methods as the ones already described for the first specific example, thereby obtaining powder compacts with densities of about 3.85 g/cm$^3$ to about 4.02 g/cm$^3$. The mean particle sizes of the fine powders are also shown in the following Table 8 and were measured by the same method as that of the first specific example (with the approximate 50% center particle size ($D_{50}$) regarded as the mean particle size).

TABLE 8

| Alloy | Target composition (at %) | $D_{50}$ of fine powder (μm) | HD process temperature and process time |
|---|---|---|---|
| B | $Nd_{15.9}Fe_{bal}B_{6.2}$ | 4.20 | 880° C. × 30 min. |
| C | $Nd_{15.9}Fe_{bal}Co_{1.0}B_{6.2}$ | 4.15 | 880° C. × 30 min. |
| D | $Nd_{15.3}Dy_{0.6}Fe_{bal}Co_{8.0}B_{6.2}Ga_{0.5}$ | 4.27 | 840° C. × 2 hr. |
| E | $Nd_{15.9}Fe_{bal}Co_{3.0}Ni_{1.0}B_{6.2}Ga_{0.1}$ | 4.31 | 860° C. × 30 min. |
| F | $Nd_{15.9}Fe_{bal}Co_{3.0}B_{6.2}C_{0.2}Ga_{0.1}Cu_{0.1}$ | 4.19 | 860° C. × 30 min. |

Next, the powder compacts were subjected to the HDDR process described above. Specifically, the powder compacts were heated to the HD temperatures shown in Table 8 within an argon gas flow at about 100 kPa (i.e., at the atmospheric pressure). After the atmospheres were changed into a hydrogen gas flow at about 100 kPa (i.e., at the atmospheric pressure), the powder compacts were maintained at the temperatures and for the periods of time that are shown in Table 8, thereby producing hydrogenation and disproportionation reactions. Thereafter, the powder compacts were maintained at the HD temperatures shown in Table 8 for about 30 minutes within an argon gas flow at a reduced pressure of about 5.3 kPa to produce hydrogen desorption and recombination reactions. Subsequently, the powder compacts were heated to about 880° C. and then maintained at that temperature for about 3 hours and 30 minutes within an argon gas flow at a reduced pressure of about 5.3 kPa to perform a densification heat treatment process. And then the temperature was decreased to room temperature within an argon gas flow at the atmospheric pressure to obtain samples representing specific examples of preferred embodiments of the present invention. The present inventors confirmed that the fractured surface of each of these samples obtained consisted of an aggregate structure of fine crystals that had similar appearance to the one shown in FIG. 1A.

Next, the surface of the samples was worked with a surface grinder and the densities of the samples were calculated based on the dimensions and weight thereof after the grinding process. The relative densities were also calculated on the supposition that the true density was about 7.60 g/cm$^3$. The results are shown in the following Table 9. The samples that had been subjected to the grinding process were magnetized with a pulse magnetic field of about 3.2 MA/m and then their magnetic properties were measured with a BH tracer MTR-1412 (produced by Metron, Inc.) The results are shown in the following Table 9. In Table 9, $J_{max}$ is the maximum value of magnetization J (T) of the magnetized sample when an external magnetic field H of up to about 2 tesla (T) was applied to the sample in the magnetization direction and $H_k$ is a value of the external magnetic field H when $B_r \times 0.9$ as in the first specific example described above.

TABLE 9

| Alloy | Density ($g/cm^3$) | Relative density (%) | $B_r$ (T) | $H_{cJ}$ (kA/m) | $(BH)_{max}$ ($kJ/m^3$) | $B_r/J_{max}$ | $H_k/H_{cJ}$ |
|---|---|---|---|---|---|---|---|
| B | 7.36 | 96.8 | 0.96 | 380 | 142 | 0.94 | 0.36 |
| C | 7.34 | 96.6 | 1.16 | 554 | 163 | 0.96 | 0.38 |
| D | 7.15 | 94.1 | 1.03 | 1306 | 174 | 0.95 | 0.58 |
| E | 7.20 | 94.7 | 1.12 | 830 | 183 | 0.96 | 0.55 |
| F | 7.13 | 93.8 | 1.15 | 872 | 238 | 0.97 | 0.65 |

Based on the results of this specific example, the present inventors confirmed that a microcrystalline high-density magnet with good loop squareness, which is one of the effects of preferred embodiments of the present invention, could be obtained no matter which of these R-T-Q alloy compositions was adopted and that the same effect was also achieved even when Fe was partially replaced with Co and/or Ni.

EXAMPLE 6

Rapidly solidified alloys G through N, of which the target compositions are shown in the following Table 10, were made by a strip casting process. Alloy J is the same as Alloy A of the first specific example described above. The rapidly solidified alloys thus obtained were coarsely pulverized, finely pulverized and then compacted under a magnetic field by the same methods as the ones already described for the first specific example, thereby obtaining powder compacts with densities of about 3.85 $g/cm^3$ to about 4.02 $g/cm^3$. The mean particle sizes of the fine powders are also shown in the following Table 10 and were measured by the same method as that of the first specific example (with the approximate 50% center particle size ($D_{50}$) regarded as the mean particle size).

TABLE 10

| Alloy | Target composition (at %) | $D_{50}$ of fine powder (μm) |
|---|---|---|
| G | $Nd_{15.9}Fe_{bal}Co_{1.0}B_{6.2}Ga_{0.1}$ | 4.14 |
| H | $Nd_{15.9}Fe_{bal}Co_{1.0}B_{6.2}Ga_{0.1}Al_{0.5}$ | 4.14 |
| I | $Nd_{15.9}Fe_{bal}Co_{1.0}B_{6.2}Ga_{0.1}Cu_{0.5}$ | 4.43 |
| J | $Nd_{15.9}Fe_{bal}Co_{1.0}B_{6.2}Ga_{0.1}Cu_{0.1}Al_{0.5}$ | 4.31 |
| K | $Nd_{15.9}Fe_{bal}Co_{1.0}B_{6.2}Ga_{0.1}Cu_{0.2}Al_{0.5}$ | 4.49 |
| L | $Nd_{15.9}Fe_{bal}Co_{1.0}B_{6.2}Ga_{0.1}Cu_{0.1}Al_{0.5}Zr_{0.1}$ | 4.25 |
| M | $Nd_{15.9}Fe_{bal}Co_{1.0}B_{6.2}Ga_{0.1}Cu_{0.1}Al_{0.5}Nb_{0.1}$ | 4.27 |
| N | $Nd_{15.9}Fe_{bal}Co_{1.0}B_{6.2}Ga_{0.1}Cu_{0.1}Al_{0.5}Ti_{0.1}$ | 4.22 |

Next, the powder compacts were subjected to the HDDR process described above. Specifically, the powder compacts were heated to about 880° C. within an argon gas flow at about 100 kPa (that is the atmospheric pressure). After the atmospheres were changed into a hydrogen gas flow at about 100 kPa (that is the atmospheric pressure), the powder compacts were maintained at about 880° C. for about 30 minutes, thereby producing hydrogenation and disproportionation reactions. Thereafter, the powder compacts were maintained at about 880° C. for about 30 minutes within an argon gas flow at a reduced pressure of about 5.3 kPa to produce hydrogen desorption and recombination reactions. Subsequently, the powder compacts were heated to 880° C. and then maintained at that temperature for about 3 hours and 30 minutes within an argon gas flow at a reduced pressure of about 5.3 kPa to perform a densification heat treatment process. And then the temperature was decreased to room temperature within an argon gas flow at the atmospheric pressure to obtain samples representing specific examples of preferred embodiments of the present invention. The present inventors confirmed that the fractured surface of each of these samples obtained consisted of an aggregate structure of fine crystals that had similar appearance to that shown in FIG. 1A.

Next, the surface of the samples was worked with a surface grinder and the densities of the samples were calculated based on the dimensions and weight thereof after the grinding process. The relative densities were also calculated on the supposition that the true density was about 7.60 $g/cm^3$. The results are shown in the following Table 11. The samples that had been subjected to the grinding process were magnetized with a pulse magnetic field of about 3.2 MA/m and then their magnetic properties were measured with a BH tracer MTR-1412 (produced by Metron, Inc.) The results are shown in the following Table 11. In Table 11, $J_{max}$ is the maximum value of magnetization J (T) of the magnetized sample when an external magnetic field H of up to about 2 tesla (T) was applied to the sample in the magnetization direction and $H_k$ is a value of the external magnetic field H when $B_r \times 0.9$ as in the first specific example described above.

TABLE 11

| Alloy | Density ($g/cm^3$) | Relative density (%) | $B_r$ (T) | $H_{cJ}$ (kA/m) | $(BH)_{max}$ ($kJ/m^3$) | $B_r/J_{max}$ | $H_k/H_{cJ}$ |
|---|---|---|---|---|---|---|---|
| G | 7.25 | 95.4 | 1.16 | 840 | 217 | 0.97 | 0.42 |
| H | 7.32 | 96.4 | 1.14 | 792 | 200 | 0.96 | 0.40 |
| I | 7.07 | 93.0 | 1.18 | 938 | 260 | 0.98 | 0.68 |
| J | 7.15 | 94.0 | 1.19 | 949 | 261 | 0.98 | 0.63 |
| K | 7.08 | 93.2 | 1.21 | 748 | 278 | 0.99 | 0.83 |
| L | 7.07 | 93.0 | 1.17 | 934 | 254 | 0.98 | 0.69 |
| M | 7.17 | 94.3 | 1.20 | 921 | 269 | 0.99 | 0.65 |
| N | 7.18 | 94.5 | 1.20 | 1006 | 271 | 0.99 | 0.67 |

FIGS. 5A, 5B, 5C, 5D, and 5E are SEM photographs showing fractured surfaces of microcrystalline high-density magnets that were made of alloys J, K, L, M and N, respectively. Any of the samples shown in these photos consists mostly of crystal grains with grain sizes of about 1 μm or less. In the sample shown in FIG. 5A, however, some areas where an abnormal grain growth occurred to sizes of about 10 μm or more are observed. In the samples shown in FIGS. 5B to 5E, on the other hand, such an abnormal grain growth during the densification heat treatment process is checked by either increasing the amount of Cu added or adding Zr, Nb or Ti. The present inventors confirmed separately that the abnormal grain growth could be limited not only by adding Zr, Nb or Ti as is done in this specific example but also by adding V, Cr, Mo, Hf, Ta of W.

Figure 5A:
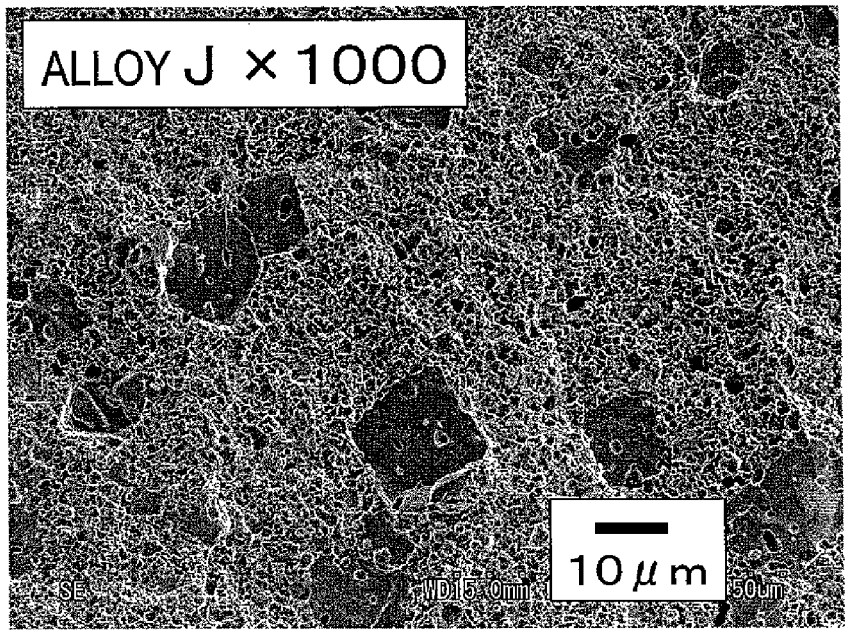
FIG. 5A is an SEM photograph showing a fractured surface of a microcrystalline high-density magnet (made of alloy J) as a specific example of a preferred embodiment of the present invention.
Figure 5B:
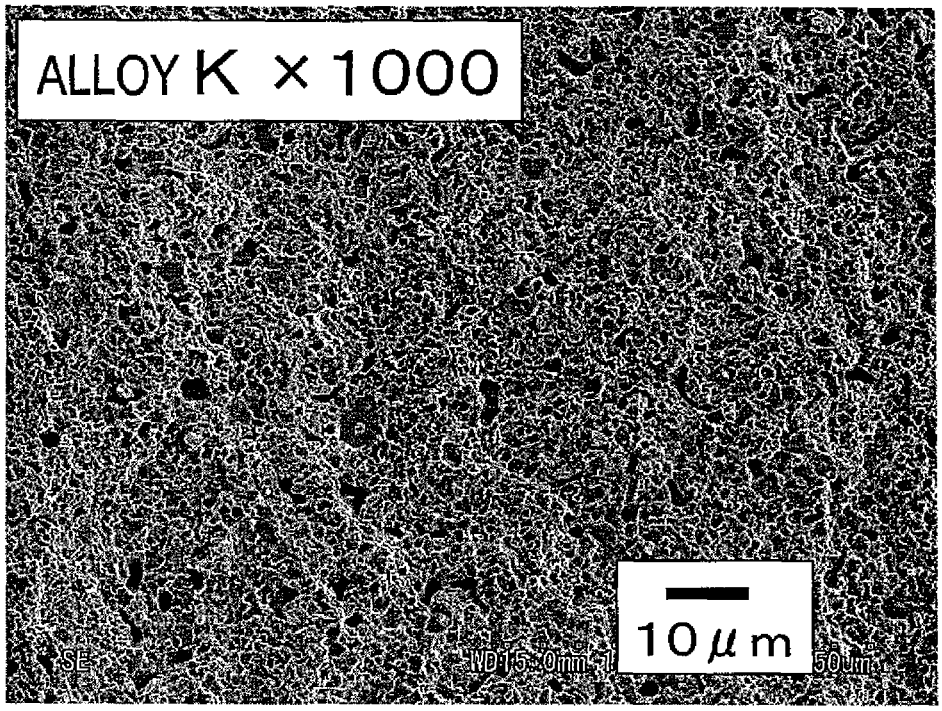
FIG. 5B is an SEM photograph showing a fractured surface of a microcrystalline high-density magnet (made of alloy K) as another specific example of a preferred embodiment of the present invention.
Figure 5C:
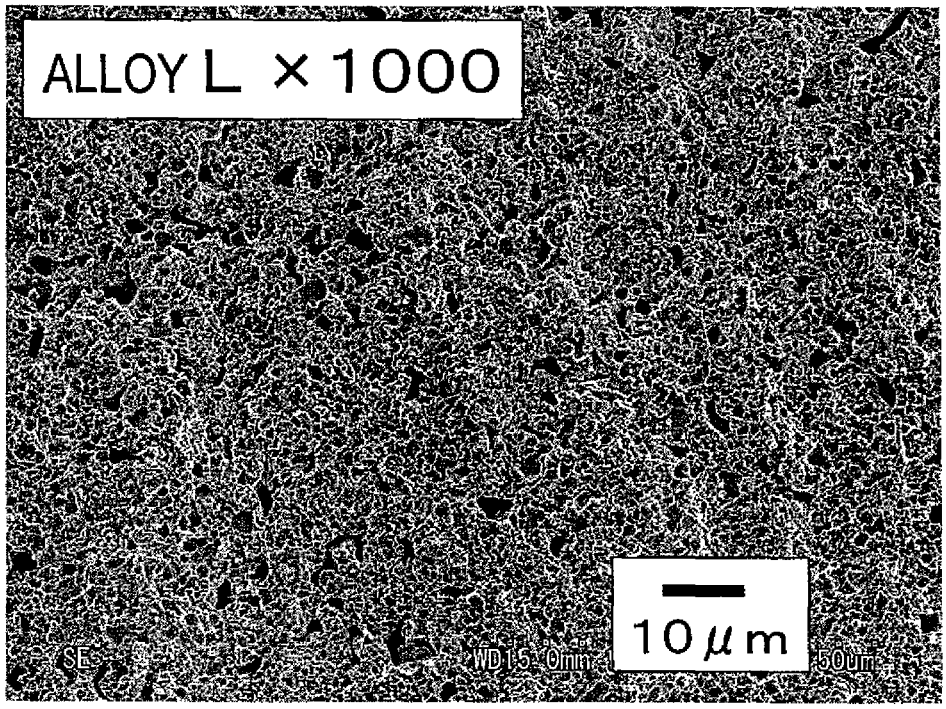
FIG. 5C is an SEM photograph showing a fractured surface of a microcrystalline high-density magnet (made of alloy L) as still another specific example of a preferred embodiment of the present invention.
Figure 5D:
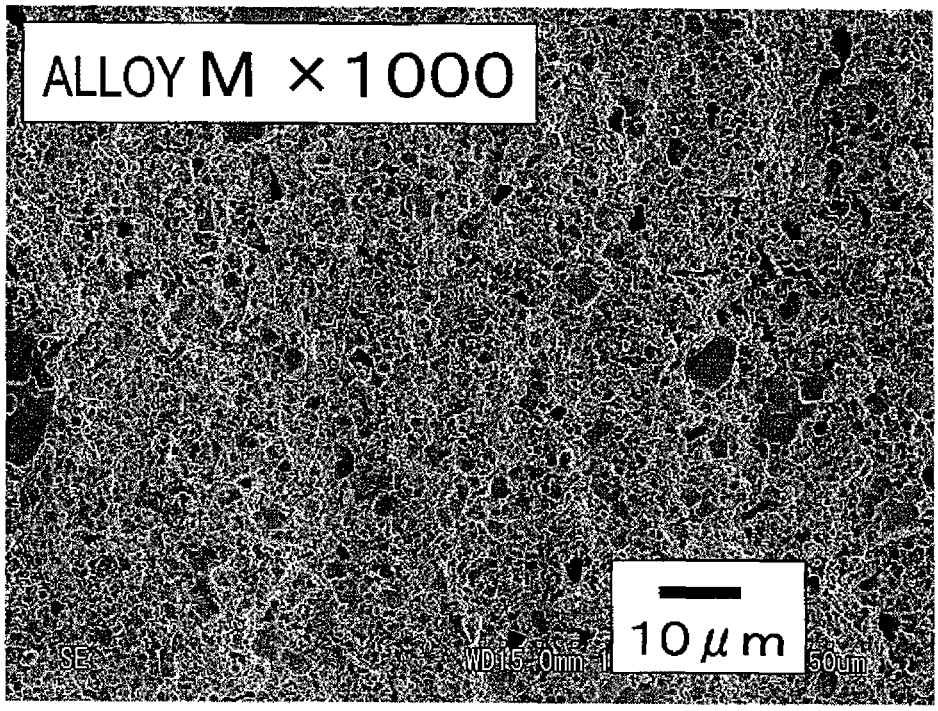
FIG. 5D is an SEM photograph showing a fractured surface of a microcrystalline high-density magnet (made of alloy M) as yet another specific example of a preferred embodiment of the present invention.
Figure 5E:
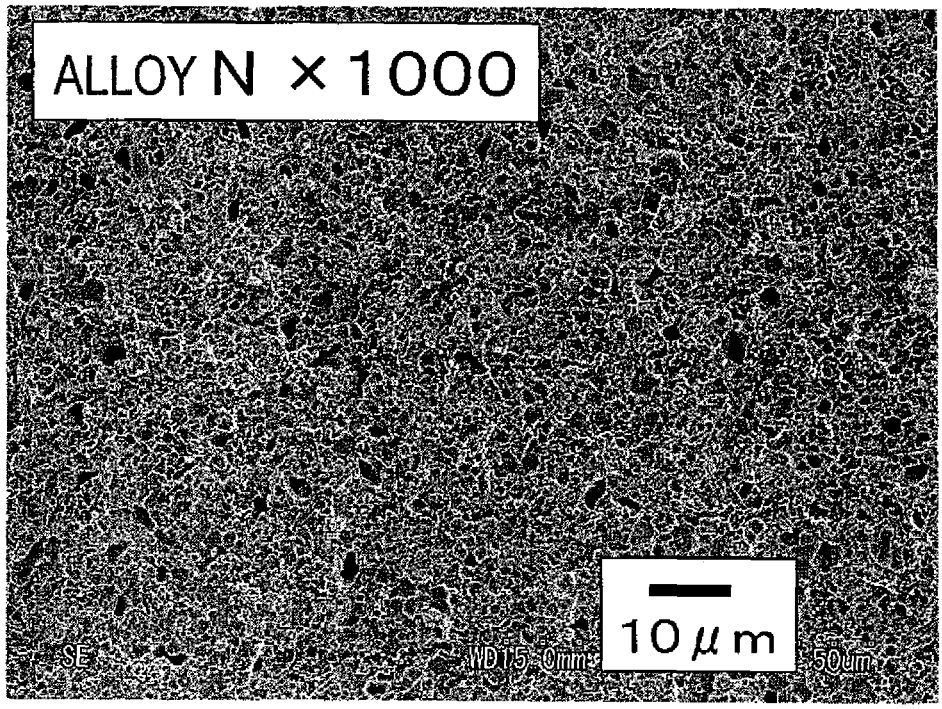
FIG. 5E is an SEM photograph showing a fractured surface of a microcrystalline high-density magnet (made of alloy N) as yet another specific example of a preferred embodiment of the present invention.

The present inventors further confirmed that alloy H, obtained by adding Al to alloy G, had an increased density. In addition, the present inventors also confirmed that alloy I, to which Cu was added, had an increased $B_r/J_{max}$ ratio, representing the degree of alignment of the sample. Furthermore, alloy K, obtained by adding a lot of Cu to alloy J, had a further increased $B_r/J_{max}$ ratio and could minimize the abnormal grain growth during the densification heat treatment process as shown in FIGS. 5A and 5B.

Based on the results of this specific example, the present inventors confirmed that a microcrystalline high-density magnet with good loop squareness, which is one of the effects of preferred embodiments of the present invention, could be obtained even if various elements were added to any of these R-T-Q alloy compositions of the present invention. The present inventors also confirmed that with those additive elements, the density could be further increased, the abnormal grain growth could be checked, the degree of alignment of the main phase (i.e., the $Nd_2Fe_{14}B$ type compound phase) could be increased, and other effects were achieved.

EXAMPLE 7

A sintered magnet was made as a comparative example using the alloy L of the sixth specific example described above and had its temperature properties compared to those of a microcrystalline high-density magnet, which had the same composition as, and had been made by the same method as, the sixth specific example described above. These two samples were magnetized with a pulse magnetic field of 3.2 MA/m and then their magnetic properties at 20° C., 60° C., 100° C. and 140° C. were measured with a BH tracer MTR-1927 (produced by Metron, Inc.) The results of the specific examples of preferred embodiments of the present invention are shown in the following Table 12, while those of the comparative examples are shown in the following Table 13.

Based on the results of these experiments, the present inventors confirmed that the specific examples of the present invention had better $H_{cJ}$ temperature coefficients, which were calculated at respective temperatures by $\Delta H_{cJ}/\Delta T \times 100/H_{cJ}$ (20° C.) with respect to 20° C. (i.e., exhibited less variations with the temperatures) than the sintered magnets. In $\Delta H_{cJ}/\Delta T \times 100/H_{cJ}$, $\Delta H_{cJ}$ is a value obtained by subtracting an $H_{cJ}$ value at 20° C. from an $H_{cJ}$ value at each measuring temperature, and $\Delta T$ is a value obtained by subtracting 20 (° C.) from each measuring temperature. As a matter of principle, a sample that has a higher $H_{cJ}$ at room temperature would have a better $H_{cJ}$ temperature coefficient. In this case, however, the specific examples of preferred embodiments of the present invention had a lower $H_{cJ}$ at room temperature, but a better $H_{cJ}$ temperature coefficient, than the comparative examples. For that reason, the $H_{cJ}$ values of the specific examples at 100° C. and 140° C. were rather higher than those of the comparative examples.

TABLE 12

| | Temperature (° C.) | $H_{cJ}$ (kA/m) | $H_{cJ}$ temperature coefficient (%/° C.) |
|---|---|---|---|
| Examples | 20 | 997 | — |
| | 60 | 779 | −0.548 |
| | 100 | 574 | −0.530 |
| | 140 | 391 | −0.507 |

TABLE 13

| | Temperature (° C.) | $H_{cJ}$ (kA/m) | $H_{cJ}$ temperature coefficient (%/° C.) |
|---|---|---|---|
| Comparative examples (sintered magnet) | 20 | 1140 | — |
| | 60 | 830 | −0.680 |
| | 100 | 562 | −0.634 |
| | 140 | 377 | −0.558 |

EXAMPLE 8

Figure 6C:
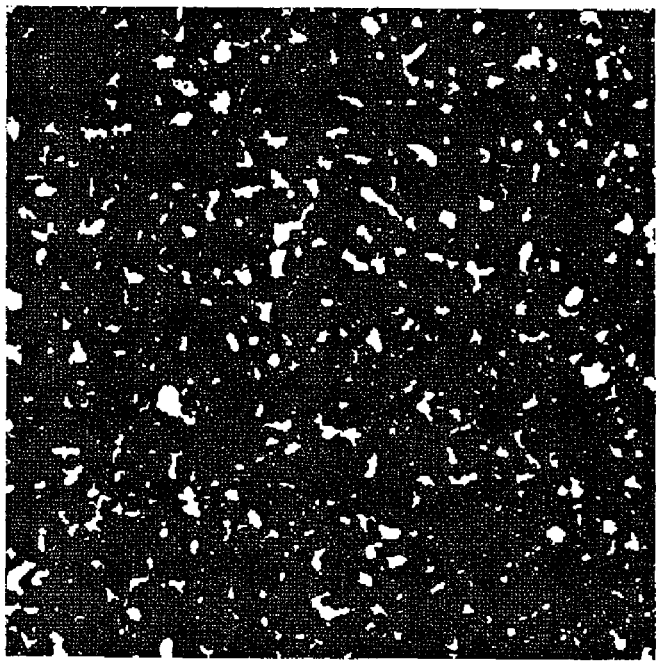
FIG. 6C is a processed SEM photograph (BSE image) showing a polished surface of a microcrystalline high-density magnet as a specific example of a preferred embodiment of the present invention.
Figure 6D:
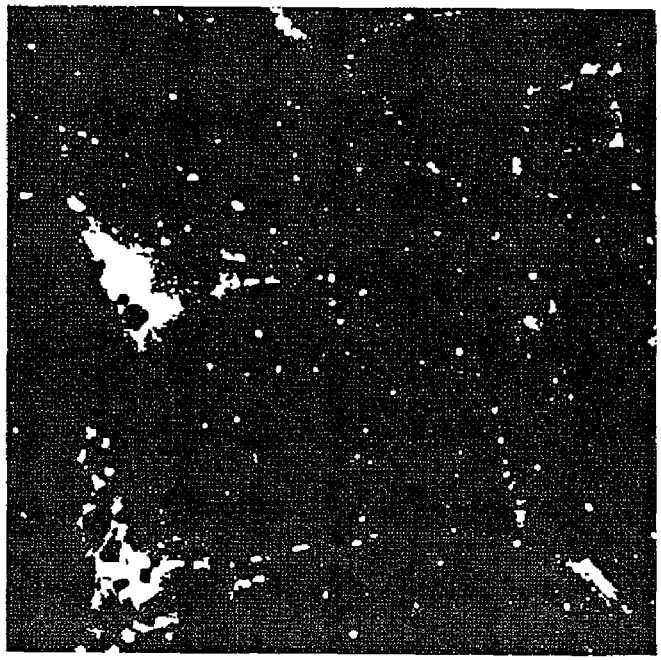
FIG. 6D is a processed SEM photograph (BSE image) showing a polished surface of Comparative Example 2.

A normal HDDR magnetic powder was prepared so as to have the composition $Nd_{12.8}Fe_{bal}Co_{16.0}B_{6.5}Ga_{0.5}Zr_{0.1}$ and a mean particle size of about 75 μm to about 300 μm and then compacted under a magnetic field with a pressure of about 200 MPa applied, thereby making a powder compact. Then, this powder compact was hot pressed at about 700° C. and about 50 MPa to obtain a high-density bulk magnet as Comparative Example 2. Meanwhile, a microcrystalline high-density magnet was made by the same method as that adopted for Example 5 using the alloy L that was used in that Example 5. And the structures obtained by the respective methods of making those two types of magnets were compared to each other using backscattered electron images of the polished surfaces (shown in FIGS. 6A through 6D) that had been taken at a zoom power of 1,000× with an SEM. Specifically, FIG. 6A is an SEM photograph showing a polished surface of the specific example of a preferred embodiment of the present invention. On the other hand, FIG. 6B is an SEM photograph showing a polished surface of Comparative Example 2. In these two photographs, the gray portion represents a main phase portion consisting of $R_2Fe_{14}B$ phases, while the white portions represent rare-earth-rich phase portions that have a composition including a lot of rare-earth elements. Each of these two structures reflects the history of the particle sizes of the material powder to a certain degree. And the present inventors confirmed that in the structure of the specific example of a preferred embodiment of the present invention, the rare-earth-rich phases were dispersed more finely than in the structure of Comparative Example 2. The 80×80 μm area of each of these photographs was subjected to binarizing processing using an image processing software program Win-ROOF (produced by Mitani Corporation) and the number of rare-earth-rich phase blocks per 80×80 μm area was counted. FIG. 6C is a photograph showing the rare-earth-rich phases that were extracted by subjecting the photo shown in FIG. 6A to image processing. The number of rare-earth-rich phases extracted was 1,236 and its density per unit area was about $1.9\times10^5$ per square millimeter. Among those rare-earth-rich phases, the number of rare-earth-rich phases with areas of about 1 $\mu m^2$ to about 10 $\mu m^2$ was 196 and its density per unit area was about $3.1\times10^4$ per square millimeter. On the other hand, FIG. 6D is a photograph obtained by subjecting the photo shown in FIG. 6B to image processing. The number of rare-earth-rich phases extracted was 498 and its density per unit area was about $0.8\times10^5$ per square millimeter. Among those rare-earth-rich phases, the number of rare-earth-rich phases with areas of about 1 $\mu m^2$ to about 10 $\mu m^2$ was 39 and its density per unit area was about $0.6\times10^4$ per square millimeter. As can be seen from these results, the microcrystalline high-density magnet of the present invention had a structure in which a lot of rare-earth-rich phase blocks were dispersed finely. On the other hand, the samples that were made using either an HDDR powder or a powder with a mean particle size of more than about 20 μm had a structure in which a smaller number of rare-earth-rich phase blocks were dispersed coarsely.

EXAMPLE 9

First, the same powder compact as that of Example 1 was made of the same alloy. Next, the powder compact was subjected to the HDDR process described above. Specifically, the powder compact was heated to about 880° C. within an argon gas flow at about 100 kPa (i.e., at the atmospheric pressure). After the atmospheres were changed into a hydrogen gas flow at about 100 kPa (i.e., at the atmospheric pressure), the powder compact was maintained at about 880° C. for about 30 minutes, thereby producing hydrogenation and disproportionation reactions. Thereafter, the powder compact was maintained at about 880° C. for about another 30 minutes within an argon gas flow at a reduced pressure of about 5.3 kPa to produce hydrogen desorption and recombination reactions. And then the temperature was decreased to room temperature within an Ar gas flow at the atmospheric pressure to obtain a porous material with a density of about 5.62 g/cm$^3$.

Next, the porous material was machined into the approximate dimensions of 7 mm×7 mm×5 mm with an outer blade cutter and a grinding machine. As a result of this machining, the porous material never cracked or chipped. Subsequently, the porous material was ultrasonic cleaned and then immersed in a nanoparticle dispersed colloidal solution, in which Co nanoparticles with a mean particle size of about 10 μm were dispersed and of which the solvent was tetradecane and the solid matter concentration was about 60 mass %. The nanoparticle dispersed colloidal solution was put into a glass container, which was then loaded into a vacuum desiccator with the porous material immersed in the solution and put under a reduced pressure. During this process, the atmospheric gas pressure was adjusted to about 130 Pa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to about 200° C. under an atmospheric gas pressure of about 130 Pa, thereby vaporizing the solvent and drying the material. In this manner, a sample of a composite bulk material was obtained.

The composite bulk material obtained in this manner was heated to about 880° C. and then maintained at that temperature for about 3 hours and 30 minutes within an argon gas flow, thereby performing a densification heat treatment process. And then the temperature was decreased to room temperature within an Ar gas flow at the atmospheric pressure to obtain a sample representing a specific example of the present invention. The sample had a density of about 7.13 g/cm$^3$.

Then, the sample of this specific example was magnetized with a pulse magnetic field of about 3.2 MA/m and then its magnetic properties were measured with a BH tracer MTR-1412 (produced by Metron, Inc.) The results are shown in the following Table 14. As a reference example, the magnetic properties of a sample, which is similar to Example 1 but which went through the densification heat treatment process without being subjected to the immersion process, are also shown in the following Table 14:

TABLE 14

| | $B_r$ (T) | $(BH)_{max}$ (kJ/m$^3$) | $H_{cJ}$ (kA/m) |
|---|---|---|---|
| Specific example (immersed) | 1.23 | 286 | 896 |
| Reference example (not immersed) | 1.19 | 261 | 949 |

In this specific example, the porous material was entirely immersed in the nanoparticle dispersed colloidal solution. However, since the solution can penetrate deep into the porous material through the capillarity phenomenon, just a portion of the porous material may be immersed in the nanoparticle dispersed colloidal solution.

As can be seen from these results, the microcrystalline high-density magnet made by the method according to a preferred embodiment of the present invention had an increased remanence $B_r$ compared to the magnet of this reference example that had its density increased by the densification heat treatment process without subjecting the porous material to any impregnation process. The present inventors also confirmed that in the specific example of the present invention, the demagnetization curve in the easy magnetization direction had no inflection point and that the microcrystalline high-density magnet of this specific example acted as a composite magnet including a hard magnetic phase ($Nd_2Fe_{14}B$ type compound) and a soft magnetic phase (metallic nanoparticles) in combination. An increase in $B_r$ that would have been caused due to the presence of the soft magnet phase was also confirmed.

EXAMPLE 10

A porous material that had been prepared by the same method as the one adopted in the previous Example 9 was machined into the approximate dimensions of 7 mm×7 mm×5 mm with an outer blade cutter and a grinding machine. As a result of this machining, the porous material never cracked or chipped. Subsequently, the porous material was ultrasonic cleaned and then immersed in a nanoparticle dispersed colloidal solution, in which Fe nanoparticles with an oxidized surface and with a mean particle size of about 7 nm were dispersed and of which the solvent was dodecane and the solid matter concentration was about 1.5 vol %. The nanoparticle dispersed solution was put into a glass container, which was then loaded into a vacuum desiccator with the porous material immersed in the solution and put under a reduced pressure. During this process, the atmospheric gas pressure was adjusted to about 130 kPa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to about 200° C. under an atmospheric gas pressure of about 130 Pa, thereby vaporizing the solvent and drying the material. In this manner, a sample of a composite bulk material according to a preferred embodiment of the present invention was obtained.

Figure 7:
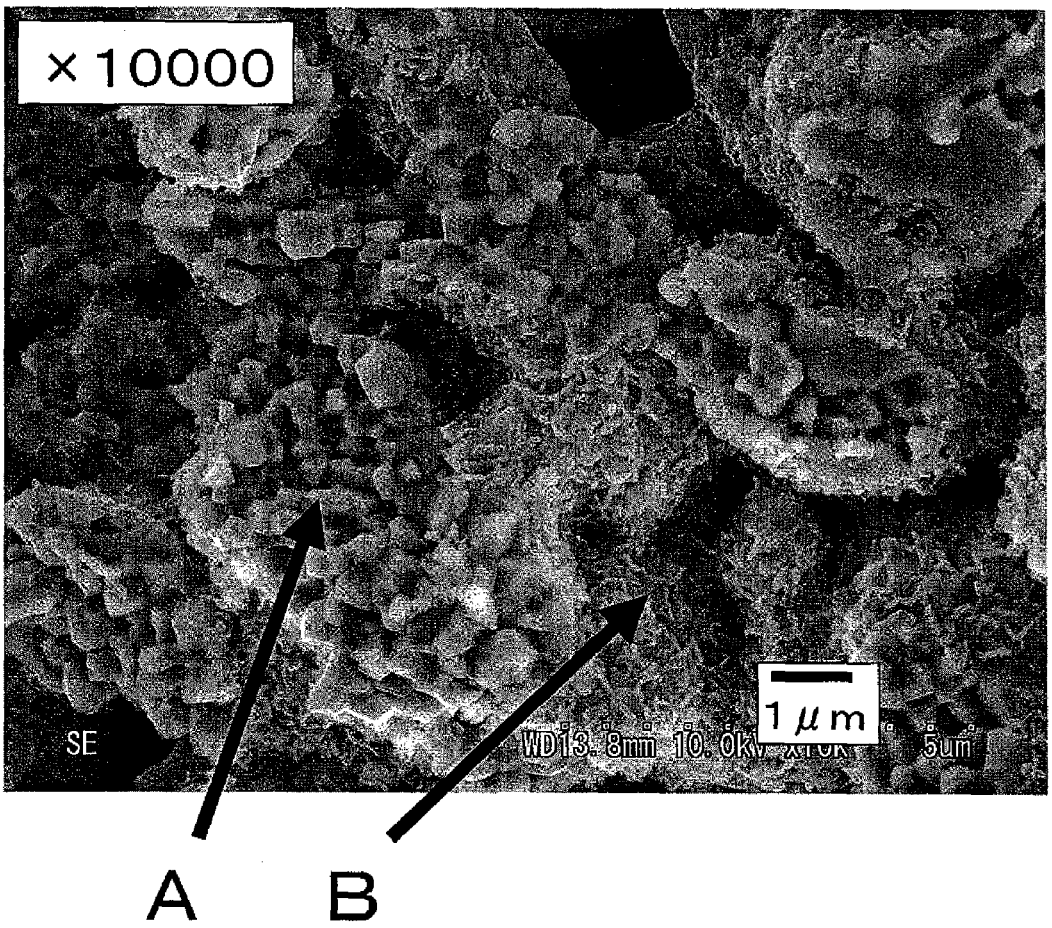
FIG. 7 is an SEM photograph showing a fractured surface of a porous material to which Fe nanoparticles were introduced.

A fractured surface of the sample thus obtained was observed with a scanning electron microscope (SEM). The result is shown in FIG. 7. As in FIG. 3, fractured surfaces characterized by area A (representing a fractured face of a porous material) and area B were identified. The intensities (or the contents) of the element Fe in those areas A and B were compared to each other using an energy dispersive X-ray detector (EDX). As a result, the Fe intensity was higher in the area B. Thus, in the area B, the Fe nanoparticles that had been dispersed in the nanoparticle dispersed colloidal solution would have been transported through the micropores of the porous material and would have remained in the micropores even after the solvent was vaporized off.

The composite bulk material obtained in this manner was heated to about 880° C. and then maintained at that temperature for about 3 hours and 30 minutes within an argon gas flow, thereby performing a densification heat treatment process. And then the temperature was decreased to room temperature within an Ar gas flow at the atmospheric pressure to obtain a sample representing a specific example of the present invention. The sample had a density of about 7.10 g/cm$^3$.

Then, the sample of this specific example was magnetized with a pulse magnetic field of about 3.2 MA/m and then its magnetic properties were measured with a BH tracer MTR-1412 (produced by Metron, Inc.) The results are shown in the following Table 15. As a reference example, the magnetic properties of a sample, which is similar to Example 1 but which went through the densification heat treatment process without being subjected to the immersion process, are also shown in the following Table 15:

TABLE 15

| | $B_r$ (T) | $(BH)_{max}$ (kJ/m$^3$) | $H_{cJ}$ (kA/m) |
|---|---|---|---|
| Specific example (immersed) | 1.25 | 291 | 870 |
| Reference example (not immersed) | 1.19 | 261 | 949 |

In this specific example, the porous material was entirely immersed in the nanoparticle dispersed colloidal solution. However, since the solution can penetrate deep into the porous material through the capillarity phenomenon, just a portion of the porous material may be immersed in the nanoparticle dispersed colloidal solution.

As can be seen from these results, the microcrystalline high-density magnet made by the method according to a preferred embodiment of the present invention had an increased remanence $B_r$ compared to the magnet of this reference example that had its density increased by the densification heat treatment process without subjecting the porous material to any impregnation process. The present inventors also confirmed that in the specific example of a preferred embodiment of the present invention, the demagnetization curve in the easy magnetization direction had no inflection point and that the microcrystalline high-density magnet of this specific example acted as a composite magnet including a hard magnetic phase ($Nd_2Fe_{14}B$ type compound phase) and a soft magnetic phase (metallic nanoparticles) in combination.

EXAMPLE 11

A porous material that had been prepared by the same method as the one adopted in Example 9 was machined into the approximate dimensions of 20 mm×20 mm×20 mm with an outer blade cutter and a grinding machine. As a result of this machining, the porous material never cracked or chipped. Subsequently, the porous material was ultrasonic cleaned and then immersed in a $DyF_3$ fine particle dispersed solution, in which $DyF_3$ fine particles with particle sizes of about 0.05 μm to about 0.5 μm were dispersed in dodecane. The $DyF_3$ fine particle dispersed solution was put into a glass container, which was then loaded into a vacuum desiccator with the porous material immersed in the solution and put under a reduced pressure. During this process, the atmospheric gas pressure was adjusted to about 130 Pa.

Due to the reduced pressure, bubbles were produced in the porous material and in the $DyF_3$ fine particle dispersed solution. And when the bubbles were no longer produced, the pressure was once raised to the atmospheric pressure. Thereafter, the porous material was inserted into a vacuum dryer and then heated to about 200° C. under an atmospheric gas pressure of about 130 Pa, thereby vaporizing the solvent and drying the material. In this manner, a sample of a composite bulk material according to the present invention was obtained.

The composite bulk material obtained in this manner was heated to about 880° C. and then maintained at that temperature for about 3 hours and 30 minutes within an argon gas flow, thereby performing a densification heat treatment process. And then the temperature was decreased to room temperature within an Ar gas flow at the atmospheric pressure to obtain a sample representing a specific example of the present invention. The sample had a density of about 7.11 g/cm$^3$.

Then, the sample of this specific example was magnetized with a pulse magnetic field of about 3.2 MA/m and then its magnetic properties were measured with a BH tracer MTR-1412 (produced by Metron, Inc.) The results are shown in the following Table 16. As a reference example, the magnetic properties of a sample, which is similar to Example 1 but which went through the densification heat treatment process without being subjected to the immersion process, are also shown in the following Table 16:

TABLE 16

| | $B_r$ (T) | $(BH)_{max}$ (kJ/m$^3$) | $H_{cJ}$ (kA/m) |
|---|---|---|---|
| Specific example (immersed) | 1.17 | 258 | 1,250 |
| Reference example (not immersed) | 1.19 | 261 | 949 |

In this specific example, the porous material was entirely immersed in the $DyF_3$ particle dispersed solution. However, since the solution can penetrate deep into the porous material through the capillarity phenomenon, just a portion of the porous material may be immersed in the $DyF_3$ particle dispersed solution.

As can be seen from these results, the microcrystalline high-density magnet made by the method according to a preferred embodiment of the present invention had an increased coercivity $H_{cJ}$ compared to the magnet of this reference example that had its density increased by the densification heat treatment process without subjecting the porous material to any impregnation process.

EXAMPLE 12

Alloys O and P, of which the target compositions are shown in the following Table 17, were made. It should be noted that the alloy O is the same as the alloy A of the first specific example. On the other hand, the alloy P was obtained by melting an alloy with the same target composition as the alloy O by an induction heating process, casting the alloy in a water-cooled die to make an ingot, and then subjecting the ingot to a homogenizing heat treatment at about 1,000° C. for approximately eight hours within an Ar atmosphere. Both of these alloys were coarsely pulverized, finely pulverized and then compacted under a magnetic field by the same methods as those already described for the first specific example, thereby obtaining powder compacts with densities of about 3.76 g/cm$^3$ to about 4.12 g/cm$^3$. The mean particle sizes of the fine powders are also shown in the following Table 17 and were measured by the same method as that of the first specific example (with the approximately 50% center particle size ($D_{50}$) regarded as the mean particle size).

Meanwhile, as Comparative Example 2, powder was also prepared by pulverizing alloy P in a metallic mortar and then classifying it into about 38 μm to about 75 μm with a classifier, and was compacted under a magnetic field, thereby making a powder compact with a density of about 4.26 g/cm$^3$.

TABLE 17

| | Alloy | Target composition (at %) | Material alloy was made by | $D_{50}$ of fine powder (μm) |
|---|---|---|---|---|
| Examples | O | $Nd_{15.9}Fe_{bal}Co_{1.0}B_{6.2}Ga_{0.1}Cu_{0.1}$ | Strip casting | 4.31 |
| | P | $Nd_{15.9}Fe_{bal}Co_{1.0}B_{6.2}Ga_{0.1}Cu_{0.1}$ | Ingot | 4.60 |
| | | | | 16.80 |

TABLE 17-continued

| | Alloy | Target composition (at %) | Material alloy was made by | $D_{50}$ of fine powder (μm) |
|---|---|---|---|---|
| Comparative Example 2 | | | | 38 to 75 μm (classifier) |

Next, the powder compacts were subjected to the HDDR process and densification heat treatment process described above. Specifically, the powder compacts were heated to about 880° C. within an argon gas flow at about 100 kPa (that is the atmospheric pressure). After the atmospheres were changed into a hydrogen gas flow at about 100 kPa (that is the atmospheric pressure), the powder compacts were maintained at about 880° C. for about 30 minutes, thereby producing hydrogenation and disproportionation reactions. Thereafter, the powder compacts were maintained at about 880° C. for about another 30 minutes within an argon gas flow at a reduced pressure of about 5.3 kPa to produce hydrogen desorption and recombination reactions. Subsequently, the powder compacts were maintained at about 880° C. for about 3 hours and 30 minutes within an argon gas flow at a reduced pressure of about 5.3 kPa, thereby performing a densification heat treatment process. And then the temperature was decreased to room temperature within an Ar gas flow at the atmospheric pressure to obtain samples representing specific examples of preferred embodiments of the present invention. The present inventors confirmed that the fractured surface of each of these samples obtained consisted of an aggregate structure of fine crystals that had similar appearance to the one shown in the photograph of FIG. 1A.

Next, the surface of the samples was worked with a surface grinder and the densities of the samples were calculated based on the dimensions and weight thereof after the grinding process. Relative densities thereof were also calculated with the true density supposed to be about 7.60 g/cm$^3$. The results are shown in the following Table 18. The present inventors confirmed that each of these samples had sufficiently high mechanical strength because the magnet never cracked even after the grinding process. On the other hand, Comparative Example 2 had too coarse a powder particle size and too small a contact area between powder particles to have its density increased even by the densification heat treatment process. In addition, Comparative Example 2 had such a low strength as to collapse during the process. The samples that had been subjected to the grinding process were magnetized with a pulse magnetic field of about 3.2 MA/m and then their magnetic properties were measured with a BH tracer MTR-1412 (produced by Metron, Inc.) The results are shown in the following Table 18. In Table 18, $J_{max}$ is the maximum value of magnetization J (T) of the magnetized sample when an external magnetic field H of up to about 2 tesla (T) was applied to the sample in the magnetization direction and $H_k$ is a value of the external magnetic field H to be $B_r \times 0.9$ as in the first specific example described above.

TABLE 18

| | Alloy | $D_{50}$ (μm) of fine powder | Density (g/cm$^3$) | Relative density (%) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|---|---|---|
| Ex. | O | 4.31 | 7.15 | 94.0 | 1.19 | 949 | 261 | 0.98 | 0.63 |
| | P | 4.60 | 7.13 | 93.8 | 1.15 | 960 | 257 | 0.97 | 0.58 |
| | | 16.80 | 7.08 | 93.2 | 1.07 | 986 | 189 | 0.95 | 0.52 |
| Comp. Ex. 2 | | 38-53 μm (classifier) | No data available because it collapsed during the process | | | | | | |

Based on the results of this specific example, the present inventors confirmed that a microcrystalline high-density magnet with good loop squareness could be obtained, no matter which of various methods was adopted to make the material alloy. The present inventors also confirmed that a relatively high $H_k/H_{cJ}$ ratio was achieved by adopting a strip casting process as a rapid cooling process that would not produce an α-Fe phase easily. Furthermore, the present inventors confirmed that by decreasing the mean particle size of the material powder to about 10 μm or less, the density could be further increased and a microcrystalline high-density magnet with an even higher density could be obtained.

A microcrystalline high-density magnet according to a preferred embodiment of the present invention has better magnetic properties (superior loop squareness, among other things) than a bonded magnet and can exhibit such excellent magnetic properties even when formed into such a shape that would cause degradation in a conventional sintered magnet. Therefore, the magnet of preferred embodiments of the present invention can be used effectively in various applications of conventional bonded magnets and sintered magnets.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A method for producing an R—Fe—B based microcrystalline high-density magnet, the method comprising the steps of:

(A) providing an R—Fe—B based rare-earth alloy powder, where R is at least one element selected from the group consisting of the rare-earth elements including Y and Sc, with a mean particle size of less than about 20 μm;

(B) compacting the R—Fe—B based rare-earth alloy powder to make a powder compact;

(C) subjecting the powder compact to a heat treatment at a temperature of about 550° C. to less than 900° C. within hydrogen gas, thereby producing hydrogenation and disproportionation reactions;

(D) subjecting the powder compact to another heat treatment at a temperature of about 550° C. to less than 900° C. within either a vacuum or an inert atmosphere, thereby producing desorption and recombination reactions and obtaining a porous material including fine crystal grains, of which a density is about 50% to about 90% of a true density thereof and which have an average crystal grain size of about 0.01 μm to about 2 μm; and (E) subjecting the porous material to yet another heat treatment at a temperature of about 750° C. to less than 900° C. within either the vacuum or the inert atmosphere so that rare-earth-rich phases with areas of 1 $\mu m^2$ to 10 $\mu m^2$ are formed at a number density of at least $1.6\times10^4$ phases per square millimeter on a cross section that passes through a center portion of the R—Fe—B based microcrystalline high-density magnet, thereby further increasing the density thereof to about 93% or more of the true density thereof without performing any hot pressing process.

2. The method of claim 1, wherein the step (B) includes compacting the powder under a magnetic field.

3. The method of claim 1, wherein the powder compact at the beginning of the step (C) comprises compositions in which the following formula (1) is satisfied, $$(\text{atomic percentage of } R)-(\text{atomic percentage of } T)\times 1/7-(\text{atomic percentage of } O)\times 2/3 \geqq 0 \text{ at \%} \quad (1$$

(where R, T, and O are elements included in the powder compact at the beginning of the step (C), R is at least one of rare-earth elements, T is at least one transition metal element selected from the group consisting of Fe, Co and Ni and including about 50% or more of Fe and O is oxygen).

4. The method of claim 1, wherein the R—Fe—B based rare-earth alloy powder is obtained by pulverizing a rapidly solidified alloy.

5. The method of claim 4, wherein the rapidly solidified alloy is a strip cast alloy.

6. The method of claim 1, wherein the step (C) includes increasing the temperature within the inert atmosphere or the vacuum and introducing the hydrogen gas after the temperature of the powder compact has increased to the temperature of about 550° C. to less than 900° C.

7. The method of claim 1, wherein in the step (C), the hydrogen gas has a partial pressure of about 1 kPa to about 100 kPa.

8. The method of claim 1, wherein the R—Fe—B based rare-earth alloy powder provided in the step (A) has a mean particle size of less than about 10 μm, and in the steps (C) and (D), the heat treatments are conducted at a temperature of about 650° C. to less than 900° C.

9. The method of claim 1, further comprising, after the step (C) and before the step (E), the step (F) of introducing a different material from the R—Fe—B based porous material into micropores of the R—Fe—B based porous material by a wet process.

10. The method of claim 1, further comprising, after the step (C) and before the step (E), the step (F') of introducing at least one of a rare-earth metal, a rare-earth alloy and a rare-earth compound onto the surface of the R—Fe—B based porous material and/or into micropores thereof.

11. The method of claim 10, wherein the steps (E) and (F') are performed simultaneously.

12. A method of making an R—Fe—B based magnet powder comprising the step of pulverizing the R—Fe—B based microcrystalline high-density magnet that has been produced by the method of claim 1.

13. A method for producing a bonded magnet, the method comprising the steps of:

preparing an R—Fe—B based magnet powder by the method of claim 12; and mixing the R—Fe—B based magnet powder with a binder and compacting the powder and the binder together.

14. The method of claim 1, wherein the R—Fe—B based microcrystalline high-density magnet has a structure in which a number of powder particles, each having an aggregate structure of $Nd_2Fe_{14}B$ type crystalline phases with an average crystal grain size of about 0.01 μm to about 2 μm, have been combined together.

* * * * *